US008844101B2

(12) United States Patent
Nozaki et al.

(10) Patent No.: US 8,844,101 B2
(45) Date of Patent: Sep. 30, 2014

(54) REVERSE OPENING SLIDE FASTENER

(75) Inventors: Jiro Nozaki, Toyama (JP); Shunji Akashi, Toyama (JP)

(73) Assignee: YKK Corporation (JP)

( * ) Notice: Subject to any disclaimer, the term of this patent is extended or adjusted under 35 U.S.C. 154(b) by 13 days.

(21) Appl. No.: 13/518,888

(22) PCT Filed: Dec. 25, 2009

(86) PCT No.: PCT/JP2009/071566
§ 371 (c)(1),
(2), (4) Date: Jun. 24, 2012

(87) PCT Pub. No.: WO2011/077544
PCT Pub. Date: Jun. 30, 2011

(65) Prior Publication Data

US 2012/0260468 A1 Oct. 18, 2012

(51) Int. Cl.
*A44B 19/26* (2006.01)
*A44B 19/38* (2006.01)
*A44B 19/28* (2006.01)

(52) U.S. Cl.
CPC ..... *A44B 19/382* (2013.01); *A44B 19/28* (2013.01)
USPC ..... 24/433; 24/436; 24/386

(58) Field of Classification Search
USPC ..... 24/386, 382, 433, 434, 436
See application file for complete search history.

(56) References Cited

U.S. PATENT DOCUMENTS 3,280,437 A 10/1966 Schwendt
4,312,103 A * 1/1982 Akashi ..... 24/386
6,195,852 B1 * 3/2001 Kusayama ..... 24/434
6,615,458 B2 * 9/2003 Takasawa et al. ..... 24/433
7,694,396 B2 4/2010 Ogura
8,402,614 B2 * 3/2013 Fujii ..... 24/433
2002/0050031 A1 * 5/2002 Takasawa et al. ..... 24/433
2006/0282998 A1 * 12/2006 Kusayama et al. ..... 24/434

(Continued)

FOREIGN PATENT DOCUMENTS

CN 1805697 A 7/2006
CN 101164467 A 4/2008

(Continued)

OTHER PUBLICATIONS

International Search Report and Written Opinion, PCT International Application No. PCT/JP2009/071655, mailed Apr. 6, 2010.

*Primary Examiner* — Robert J Sandy
*Assistant Examiner* — Rowland Do
(74) *Attorney, Agent, or Firm* — Kilpatrick Townsend & Stockton LLP

(57) ABSTRACT

A reverse opening slide fastener is provided with a pair of first and second separable connection members which are firmly fixed to first and second fastener stringers, and a pair of first and second sliders. A connection and separation operation can be carried out by inserting and removing the second separable connection member into and from the first and second sliders. The second separable connection member has an inserting and removing region which can be inserted into and removed from the first and second sliders via a gap between upper and lower flanges of the first and second sliders. Further, a positioning structure which decides a relative position between the first separable connection member and the second separable connection member is arranged, whereby it is possible to improve an operability of the connection and separation operation.

9 Claims, 20 Drawing Sheets

(56) References Cited

U.S. PATENT DOCUMENTS

| | | | | |
|---|---|---|---|---|
| 2006/0290497 | A1 | 12/2006 | Sugata | |
| 2008/0092347 | A1 | 4/2008 | Ogura | |
| 2009/0094805 | A1 | 4/2009 | Keyaki et al. | |
| 2012/0167354 | A1 * | 7/2012 | Keyaki et al. | 24/386 |

FOREIGN PATENT DOCUMENTS

| | | | |
|---|---|---|---|
| CN | 101411553 | A | 4/2009 |
| EP | 1661478 | A1 | 5/2006 |
| EP | 1913833 | A1 | 4/2008 |
| EP | 2050349 | A2 | 4/2009 |
| JP | 42-19632 | B1 | 10/1967 |
| JP | 2008-99975 | A | 5/2008 |
| JP | 2009-82730 | A | 4/2009 |
| JP | 2009-95425 | A | 5/2009 |
| KR | 10-2008-0035983 | | 4/2008 |
| KR | 10-2009-0038355 | A | 4/2009 |
| WO | 2005-018365 | A1 | 3/2005 |

* cited by examiner

REVERSE OPENING SLIDE FASTENER

This application is a national stage application of PCT/JP2009/071566 which is incorporated herein by reference.

TECHNICAL FIELD

The invention relates to a slide fastener which has a first separable connection member provided in one first fastener stringer, a second separable connection member provided in another second fastener stringer, and first and second sliders attached so as to be slidable along element rows of the first fastener stringer, and can carry out a connection and separation operation by inserting and removing the second separable connection member into and from the first and second sliders which are moved to a sliding end portion in a side of the first separable connection member.

BACKGROUND ART

Conventionally, in order to open and close, for example, right and left front bodies in clothes, a slide fastener provided with a separable connection device is frequently used. Further, in order to enhance a functionality and a design of the clothes, for example, as a slide fastener which is mainly used in a long coat, a skiwear or the like, there has been known a slide fastener which can be separated not only from one end (an upper end) of a fastener chain which form right and left element rows in an engaged state, but also from another end (a lower end). The slide fastener in which the element rows in the engaged state can be separated from both ends is called a reverse opening slide fastener.

One example of the slider fastener which can be reversely opened as mentioned above is disclosed in Japanese Patent Application Laid-Open No. 2008-99975 (Patent Document 1).

As shown in FIG. 26, a slide fastener 201 described in the Patent Document 1 is provided with a pair of left and right first and second fastener stringers 210 and 220 in which element rows 203 are formed, a first separable connection member 230 (described as a box pin in the Patent Document 1) which is arranged in a front end portion of the first fastener stringer 210 in the left side, a second separable connection member 240 (described as an insert pin in the Patent Document 1) which is arranged in a front end portion of the second fastener stringer 220 in the right side, and a first slider (an upper slider) 250*a* and a second slider (a lower slider) 250*b* which are arranged slidably along the element rows 203, and is structured such that a connection and separation operation is carried out in the front end sides of the first and second fastener stringers 210 and 220 (the slide fastener 201 mentioned above may be called an upward opening slide fastener).

Note that, in the case shown in FIG. 26, a back and forth direction indicates a longitudinal direction of a fastener tape 202 in the slide fastener 201, a direction for sliding the first slider 250*a* such that the element rows 203 couple is set to a forward direction, and a direction for sliding the first slider 250*a* such that the element rows 203 in the coupled state separate indicates a rearward direction.

A lateral direction indicates a tape width direction of the fastener tape 202, and a left side and a right side at a time of viewing the slide fastener 201 from a front face are respectively set to a left direction and a right direction. An up and down direction indicates a back and front direction of a tape which is orthogonal to a tape surface of the fastener tape 202, and a side in which a catch 257 of the first and second sliders 250*a* and 250*b* is arranged with respect to the fastener tape 202 (a near side of a paper surface in FIG. 26) is set to an upward direction, and an opposite side to it (a far side of the paper surface in FIG. 26) is set to a downward direction.

The first and second fastener stringers 210 and 220 respectively have the fastener tape 202, the element rows 203 which are formed in opposing tape side edge portions of the fastener tape 202, and a stop portion 204 which is formed in a rear end portion of the element rows 203. In this case, the element rows 203 are formed by sewing a coil-like fastener element to the fastener tape 202.

The first separable connection member 230 is continuously extended from a front end portion of the element rows 203 which are arranged in the first fastener stringer 210 in the left side. The first separable connection member 230 has a main body portion 231 which is firmly fixed to the fastener tape 202, a stopper portion 232 which is arranged in a front end side of the main body portion 231 and prevents a dropout of the first slider 250*a*, a locking piece portion 233 which protrudes out of an opposite side surface opposing to the second separable connection member 240 of the main body portion 231, and the like.

The second separable connection member 240 is continuously extended from a front end portion of the element rows 203 which are arranged in the fastener stringer in the right side. The second separable connection member 240 has a main body portion 241 which is firmly attached to the fastener tape 202, an accommodating portion 242 which is provided in a concave manner in an opposite side surface opposing to the first separable connection member 230 of the main body portion 241, and can accommodate the locking piece portion 233 of the first separable connection member 230, a contact portion 243 which protrudes out of an opposite side surface to the main body portion 241, and a notch portion 244 which is formed in a front end side of the main body portion 241.

The first and second sliders 250*a* and 250*b* have upper and lower blades 251 and 252, a diamond 253 which connects between the upper and lower blades 251 and 252, flanges 254 which are provided in right and left side edges of the upper and lower blades 251 and 252, a locking pawl 255 which is slidably arranged in the upper blade 251 and retains a stop position of the slider with respect to the element rows 203, a catch attaching post 256 which rises from an upper surface of the upper blade 251, and the catch 257 which is retained to the catch attaching post 256. Further, an element guide path 258 is formed between the upper and lower blades 251 and 252 in the first and second fastener stringers 210 and 220.

Further, the first and second sliders 250*a* and 250*b* are attached to the element rows 203 of the first fastener stringer 210 in such a direction that respective rear ports are opposed, and the first slider 250*a* is arranged closer to the first separable connection member 230 than the second slider 250*b*.

Next, in the slide fastener 201 of the Patent Document 1 as mentioned above, for example, a description will be given of a case that the first and second fastener stringers 210 and 220 are closed by engaging the right and left element rows 203 from a state in which the first and second fastener stringers 210 and 220 are open (separated).

First of all, the first and second sliders 250*a* and 250*b* attached to the element rows 203 of the first fastener stringer 210 are slid so as to be moved to a sliding end portion in a side of the first separable connection member 230. Subsequently, the second separable connection member 240 is inserted with respect to the first and second sliders 250*a* and 250*b* which moved to the sliding end portion.

In this inserting operation, the second separable connection member 240 is inserted into the element guide path 258 of the second slider 250*b* and the element guide path 258 of the first slider 250*a* from a shoulder port of the second slider 250*b*, as shown in FIG. 27. Further, the locking piece portion 233 of the first separable connection member 230 is accommodated in the accommodating portion 242 of the second separable connection member 240, and the second separable connection member 240 is inserted sufficiently to a far side in the element guide path 258 of the second slider 250*b*, whereby the inserting operation of the second separable connection member 240 is completed, as shown in FIG. 28.

Thereafter, the right and left element rows 203 can be engaged as shown in FIG. 29, by making the second slider 250*b* in the lower side toward a rear side along the element rows 203, whereby it is possible to close the slide fastener 201.

In accordance with the Patent Document 1, since the locking pawl 255 of the first slider 250*a* in the upper side can come into contact with the contact portion 243 of the second separable connection member 240 in a state in which the slide fastener 201 is closed, it is possible to prevent the first slider 250*a* from moving rearward without carrying out any artificial operation.

Note that, in order to separate the slide fastener 201 in the closed state as mentioned above, the second slider 250*b* in the lower side is moved to the sliding end portion in which it comes into contact with the first slider 250*a* in the upper side, and the second separable connection member 240 which is inserted to the element guide path 258 of the first and second sliders 250*a* and 250*b* is thereafter drawn out via the shoulder port of the second slider 250*b*. In accordance with this, the first and second fastener stringers 210 and 220 are separated.

PRIOR ART DOCUMENT

Patent Document

Patent Document 1: Japanese Patent Application Laid-Open No. 2008-99975

SUMMARY OF THE INVENTION

Problems to be Solved by the Invention

In the conventional reverse opening slide fastener 201 as described in the Patent Document 1, in the case of closing the left and right first and second fastener stringers 210 and 220 from the separated state, as mentioned above, the inserting operation of the second separable connection member 240 is performed, in which the second separable connection member 240 is inserted from the shoulder port of the second slider 250*b*, and is inserted to the far side in the element guide path 258 of the first slider 250*a*.

However, in the reverse opening slide fastener 201, a position of a leading end portion of the second separable connection member 240 is concealed in the second slider 250*b* and the first slider 250*a* so as to be invisible, at a time of inserting the second separable connection member 240 into the element guide paths 258 of the second slider 250*b* and the first slider 250*a* via the shoulder port of the second slider 250*b*.

As a result, since it is necessary to comprehend the inserted state of the second separable connection member 240 by groping, it is hard to determine whether or not the second separable connection member 240 is inserted to a predetermined position. In accordance with this, there has been such a problem that the sliding operation of the second slider 250*b* is frequently carried out without sufficiently inserting the second separable connection member 240 to the predetermined position.

Further, if it is intended to slide the second slider 250*b* in the engaging direction of the element rows 203 while keeping a state in which the insertion of the second separable connection member 240 with respect to the first and second sliders 250*a* and 250*b* is insufficient, as mentioned above, the second slider 250*b* catches on the second separable connection member 240 or the like and can not be slid.

In accordance with this, it is necessary to draw the second separable connection member 240 out of the first and second sliders 250*a* and 250*b* so as to be reinserted, and it comes to one of reasons which lowers an operability of the reverse opening slide fastener. Further, in the case that the second slider 250*b* catches as mentioned above and can not slide, some user may draw the second slider 250*b* by force and break the slide fastener 201. Accordingly, in the conventional reverse opening slide fastener, it has been desired to improve the connection and separation operation at a time of closing or separating the right and left fastener stringers.

The invention has been made in view of the conventional problem into consideration, and a particular object of the invention is to provide a reverse opening slide fastener which can smoothly carry out a connection and separation operation by securely and stably carrying out an insertion or a removal of a second separable connection member with respect to first and second sliders, at a time of closing or separating a pair of fastener stringers.

Means for Solving the Problems

In order to achieve the object mentioned above, a reverse opening slide fastener provided by the invention is a reverse opening slide fastener which is provided, as a basic structure, with a pair of first and second fastener stringers in which element rows are formed in tape side edge portions of left and right fastener tapes, a pair of first and second separable connection members which are firmly fixed to one end portions of the element rows in the fastener tape of the first and second fastener stringers, and a pair of first and second sliders which are attached slidablly along the element rows of the first stringer, and is capable of carrying out a connection and separation operation by inserting and removing the second separable connection member into and from the first and second sliders, being most mainly characterized in that the second separable connection member has an inserting and removing region which is capable of being inserted and removed into and from the first and second sliders via a gap of a side edge portion of an upper blade and a side edge portion of a lower blade which are arranged respectively in the first and second sliders, and a positioning structure is arranged so as to decide a relative position between the first separable connection member and the second separable connection member, at a time of an inserting and removing operation of the second separable connection member into and from the first separable connection member.

In the slide fastener in accordance with the invention, it is preferable that the second separable connection member has a main body portion which is firmly fixed to the fastener tape, and a slider engaging and disengaging portion which is arranged in a leading end portion in a tape length direction in the main body portion and is capable of engaging with and disengaging from the first slider, and the positioning structure is constructed by a retaining structure which retains the first slider to the sliding end portion, and the slider engaging and disengaging portion.

In this case, it is particularly preferable that the slider engaging and disengaging portion is formed in such a manner as to be capable of rotating the second separable connection member in an inserting and removing direction with respect to the first and second slider, in a state of being locked with the first slider.

Further, it is preferable that the first and second sliders have upper and lower blades, a diamond which connects between the upper and lower blades, an upper flange which is provided so as to be hanged from right and left side edges of the upper blade, and a lower flange which is provided so as to rise from right and left side edges of the lower blade, and the shoulder side end portion in the first slider includes a shoulder port side end edge portion of the upper blade, a shoulder port side end edge portion of the lower blade, the diamond, a shoulder port side end portion of the upper flange, and a shoulder port side end portion of the lower flange.

Further, it is preferable that the second separable connection member has a guide portion in a base end portion of the element row side in the main body portion, and the guide portion is arranged in such a manner as to be capable of going into the element guide path from the shoulder port of the second slider at a time of inserting the second separable connection member into the first and second sliders in the case that the second slider is at a predetermined position.

Further, it is preferable that the second separable connection member has a locking convex portion which is provided so as to protrude in a tape width direction from an opposite side edge opposing to the first separable connection member of the main body portion, or a locking concave portion which is provided so as to concave toward a tape inner side from the opposite side edge, and the first separable connection member has a locking concave portion which fits the locking convex portion arranged in the second separable connection member, or a locking convex portion which fits into the locking concave portion arranged in the second separable connection member.

Further, it is preferable that the second separable connection member has a position retaining elevated portion which comes into contact with a rear port side end portion of at least one of the upper and lower flanges of the first slider so as to retain the second separable connection member at a predetermined position, in at least one of a first surface and a second surface of the main body portion.

Further, it is preferable that the second separable connection member has a removal preventing elevated portion which prevents the second separable connection member from being removed from the first slider at a time when the first slider slides on the second separable connection member, in at least one of the first surface and the second surface of the main body portion, and the removal preventing elevated portion is arranged in the inserting and removing region of the second slider side.

In this case, it is preferable that a distance between the upper and lower flanges which are arranged in the second separable connection member side in the first slider is set to be smaller than a thickness of the removal preventing elevated portion, and a distance between the upper and lower flanges which are arranged in the second separable connection member side in the second slider is set to be larger than the thickness of the removal preventing elevated portion.

Further, it is preferable that a distance between the upper and lower flanges which are arranged in the first separable connection member side in the first slider is set to be the same as a distance between the upper and lower flanges which are arranged in the second separable connection member side of the second slider, and a distance between the upper and lower flanges which are arranged in the first separable connection member side in the second slider is set to be the same as a distance between the upper and lower flanges which are arranged in the second separable connection member side of the first slider.

Further, in the reverse opening slide fastener in accordance with the invention, it is preferable that the retaining structure is constructed by a locking pawl which is arranged in the first slider, and is capable of retaining a stop position of the first slider with respect to the element rows, and an accommodating concave portion which is formed in the first separable connection member and is capable of receiving the locking pawl.

Effect of the Invention

In the reverse opening slide fastener in accordance with the invention, the second separable connection member which is arranged in the second fastener stringer has the inserting and removing region which can be inserted into and removed and from the first and second sliders via the gap between the side edge portion of the upper blade and the side edge portion of the lower blade which are respectively arranged in the first and second sliders (for example, the gap between the upper and lower flanges which are arranged respectively in the first and second sliders). Further, the reverse opening slide fastener is arranged with the positioning structure which inserts the second separable connection member into the first and second sliders, and decides the relative position between the first separable connection member and the second separable connection member at a time of carrying out the connection and separation operation of the second separable connection member with respect to the first separable connection member.

Accordingly, it is possible to insert and remove the second separable connection member via the gap between the side edge portions of the upper and lower blades in the first and second sliders without conventionally inserting and removing it via the shoulder port of the second slider, at a time of inserting and removing the second separable connection member into and from the first and second sliders, after moving the first and second sliders to the sliding end portion in the first separable connection member side.

It is possible to make an inserting distance and a removing distance of the second separable connection member shorter so as to more easily insert the second separable connection member to a predetermined position, for example, in comparison with a case that the second separable connection member is inserted to and removed from the shoulder port of the second slider, by inserting and removing the second separable connection member via the gap between the side edge portions of the first and second sliders as mentioned above. Further, in the invention, since the positioning structure is arranged, it is possible to easily position the second separable connection member at a predetermined position with respect to the first separable connection member, at a time of carrying out the fitting and inserting operation by inserting the second separable connection member into the first and second sliders.

Accordingly, it is possible to reduce a possibility that the insertion of the second separable connection member with respect to the first and second sliders becomes insufficient, at a time of closing the slide fastener in which the left and right first and second fastener stringers are separated. Accordingly, it is possible to reduce such problems that the second separable connection member is reinserted, the slide fastener is broken by drawing the second slider by force or the like, and it is possible to improve an operability of the connection and separation operation in the reverse opening slide fastener.

In the reverse opening slide fastener in accordance with the invention, the second separable connection member has the main body portion which is firmly fixed to the fastener tape, and the slider engaging and disengaging portion which is arranged in the leading end portion in the tape length direction in the main body portion and can be engaged with and disengaged from the first slider, and the positioning structure is constructed by the retaining structure which retains the first slider to the sliding end portion, and the slider engaging and disengaging portion.

In accordance with this, it is possible to carry out the inserting operation of the second separable connection member and it is possible to position the second separable connection member with respect to the first slider, by locking (catching) the slider engaging and disengaging portion of the second separable connection member with the first slider which is retained to the slidable end portion, particularly the shoulder port side end portion of the first slider, at a time of inserting the second separable connection member to the first and second sliders. Accordingly, it is possible to more securely insert the second separable connection member to the predetermined position.

In this case, since the slider engaging and disengaging portion is formed rotatably in the direction of inserting and removing the second separable connection member to and from the first and second sliders in a state in which it is locked with the first slider, it is possible to smoothly carry out the inserting operation of the second separable connection member.

In the invention, the first and second sliders have the upper and lower blades, the diamond which connects between the upper and lower blades, the upper flange which is provided so as to be hanged from the right and left side edges of the upper blade, and the lower flange which is provided so as to rise from the right and left side edges of the lower blade. Further, the shoulder side end portion in the first slider includes the shoulder port side end edge portion of the upper blade, the shoulder port side end edge portion of the lower blade, the diamond, the shoulder port side end portion of the upper flange, and the shoulder port side end portion of the lower flange. In accordance with this, it is possible to securely lock the slider engaging and disengaging portion of the second separable connection member to the shoulder port side end portion of the first slider, at a time of inserting the second separable connection member to the first and second sliders, whereby it is possible to smoothly carry out the inserting operation of the second separable connection member.

Further, the second separable connection member has the guide portion in the base end portion of the element row side in the main body portion, and the guide portion is arranged in such a manner as to be capable of going into the element guide path from the shoulder port of the second slider at a time of inserting the second separable connection member into the first and second sliders in the case that the second slider is at the predetermined position.

In accordance with this, it is possible to check out that the first and second sliders move to the sliding end portion of the first separable connection member side, at a time of inserting the second separable connection member to the first and second sliders. Further, it is possible to make the user check out that the second separable connection member rotates to the predetermined position which allows the second slider to slide, at a time when the guide portion is accommodated in the element guide path of the second slider.

Further, the second separable connection member has the locking convex portion which is provided so as to protrude in the tape width direction from the opposite side edge opposing to the first separable connection member of the main body portion, or the locking concave portion which is provided so as to concave toward the tape inner side from the opposite side edge. Further, the first separable connection member has the locking concave portion which fits the locking convex portion arranged in the second separable connection member, or the locking convex portion which fits into the locking concave portion arranged in the second separable connection member.

In accordance with this, it is possible to stabilize the relative position of the second separable connection member with respect to the first separable connection member at a time of sliding the second slider or the first slider after inserting the second separable connection member, whereby it is possible to prevent a displacement in the second separable connection member. Accordingly, it is possible to smoothly carry out the sliding motion of the second slider or the first slider, and it is possible to prevent the engaging position of the right and left element rows from being shifted.

Further, the second separable connection member has the position retaining elevated portion which comes into contact with the rear port side end portion of at least one of the upper and lower flanges of the first slider so as to retain the second separable connection member at the predetermined position, in at least one of the first surface and the second surface of the main body portion.

In accordance with this, it is possible to align the first slider at a time when the position retaining elevated portion comes into contact with the rear port side end portion of the upper and lower flanges in the first slider, at a time of inserting the second separable connection member to the first and second sliders, and it is possible to prevent the displacement in the second separable connection member by stabilizing the relative position of the second separable connection member with respect to the first slider.

Further, the second separable connection member has the removal preventing elevated portion, in at least one of the first surface and the second surface of the main body portion, and the removal preventing elevated portion is arranged in the inserting and removing region in the second slider side. In this case, the distance between the upper and lower flanges which are arranged in the second separable connection member side in the first slider is set to be smaller than the thickness of the removal preventing elevated portion, and the distance between the upper and lower flanges which are arranged in the second separable connection member side in the second slider is set to be larger than the thickness of the removal preventing elevated portion.

In accordance with this, it is possible to prevent the second separable connection member from removing from the first slider at a time when the first slider is separated from the slider engaging and disengaging portion so as to slide on the second separable connection member, and it is possible to stably carry out the opening and closing operation of the reverse opening slide fastener by the first slider.

Further, the distance between the upper and lower flanges which are arranged in the first separable connection member side in the first slider is set to be the same as the distance between the upper and lower flanges which are arranged in the second separable connection member side of the second slider, and the distance between the upper and lower flanges which are arranged in the first separable connection member side in the second slider is set to be the same as the distance between the upper and lower flanges which are arranged in the second separable connection member side of the first slider. In accordance with this, it is possible to use the slider having the same shape for the first slider and the second slider. Accordingly, it is possible to achieve a reduction of a manufacturing cost, and it is possible to prevent the worker from erroneously attaching the first slider and the second slider at a time of assembling the slide fastener.

Further, in the reverse opening slide fastener in the invention, the retaining structure is constructed by the locking pawl which is arranged in the first slider, and can retain the stop position of the first slider with respect to the element rows, and the accommodating concave portion which is formed in the first separable connection member and can accommodate the locking pawl.

In accordance with this, since it is possible to securely retain the first slider at the position of the sliding end portion in the first separable connection member side at a time of carrying out the connection and separation operation of the reverse opening slide fastener, it is possible to stably position the second separable connection member locked with the first slider at the predetermined position. Accordingly, it is possible to more stably carry out the inserting and removing operation of the second separable connection member, and it is possible to smoothly carry out the connection and separation operation.

MODE FOR CARRYING OUT THE INVENTION

Preferable embodiments of the present invention will be described in detail below with reference to examples and the drawings. Note that, the present invention is not limited to each of the embodiments described below, but can be variously changed as long as it has substantially the same structure as the present invention and achieves the same operational effect.

For example, in the following embodiment, a description will be given of a case that a first separable connection member is arranged in a rear end side of a fastener stringer in a right side, and a second separable connection member is arranged in a rear end side of a fastener stringer in a left side. However, the invention is not limited to this, but can be, for example, applied in the same manner to a case that the second separable connection member is arranged in the fastener stringer in the right side, and the first separable connection member is arranged in the fastener stringer in the left side, and a case that the first and second separable connection members are arranged in front end sides of the fastener stringers.

Further, in the following embodiment, a single fastener element made of a synthetic resin is attached to a tape side edge portion of a fastener tape by an injection molding, whereby element rows are formed. However, in the invention, the element rows may be formed by sewing a coil-shaped or zigzag-shaped fastener element to a tape side edge portion of a fastener tape, or the element rows may be formed by attaching a fastener element made of a metal by caulking processing.

Embodiment 1

Figure 1:
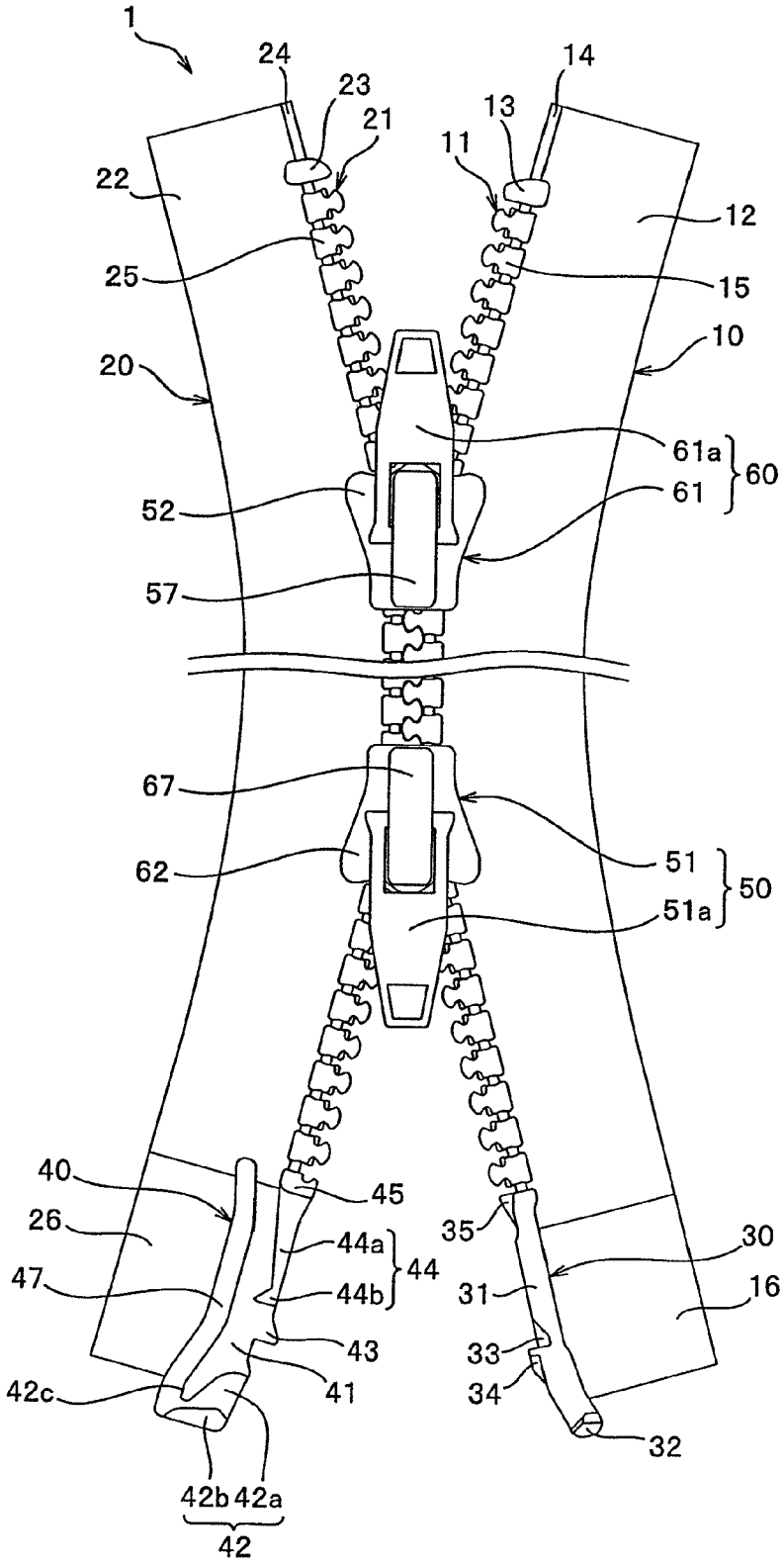
FIG. 1 is a front view showing a reverse opening slide fastener in accordance with embodiment 1 of the invention.
Figure 2:
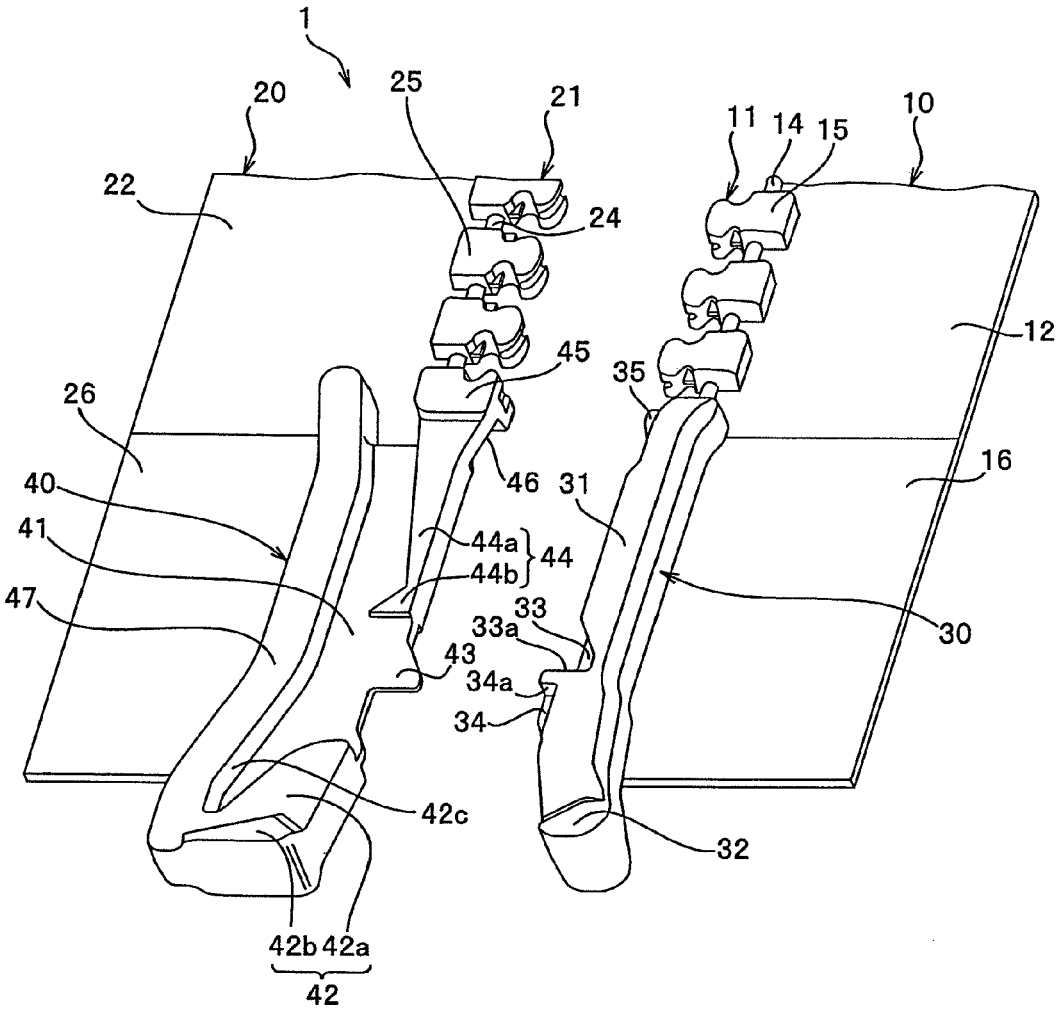
FIG. 2 is an enlarged view of a substantial part showing first and second separable connection members in the reverse opening slide fastener.
Figure 3:
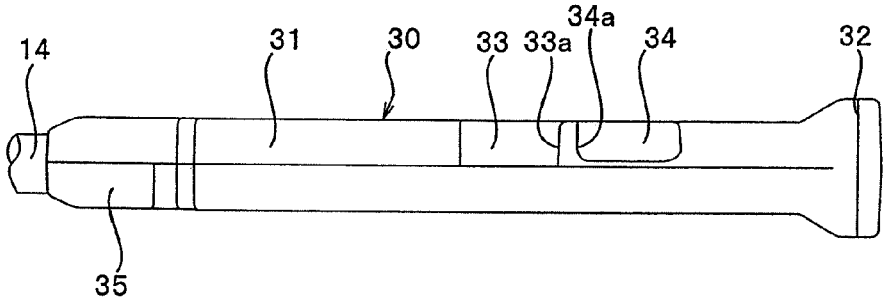
FIG. 3 is a side view of the first separable connection member.
Figure 4:
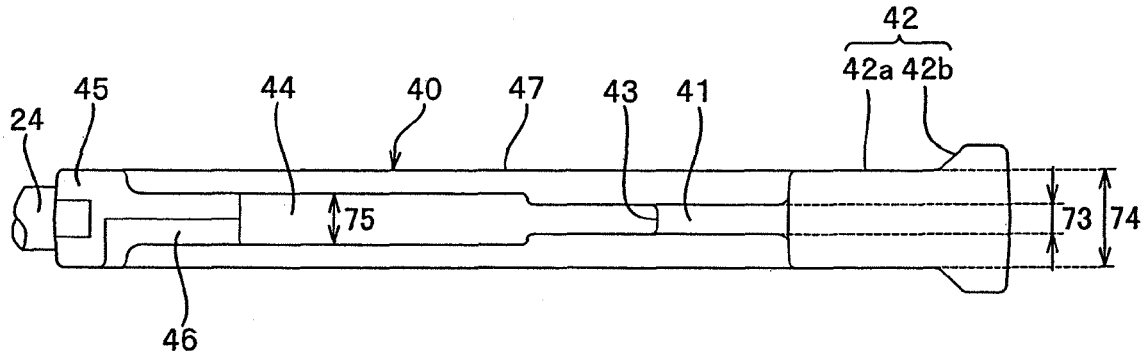
FIG. 4 is a side view of the second separable connection member.
Figure 5:
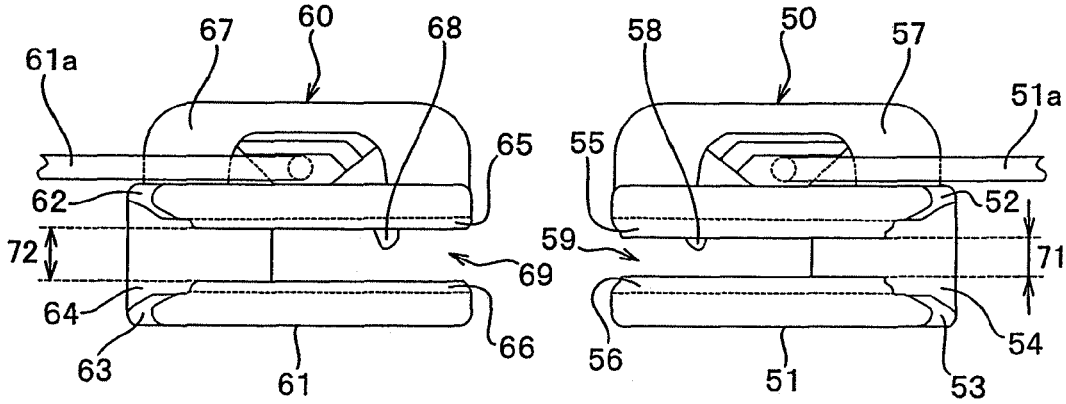
FIG. 5 is a side view of first and second sliders.

FIG. 1 is a front view showing a reverse opening slide fastener in accordance with the present embodiment 1, and FIG. 2 is an enlarged view of a substantial part showing first and second separable connection members in the reverse opening slide fastener. Further, FIGS. 3 and 4 are respective side views of the first and second separable connection members, and FIG. 5 is a side view of first and second sliders.

Note that, in the following description, a back and forth direction indicates a longitudinal direction of a fastener tape in the slide fastener, a direction for sliding the second slider such that the element rows engage is set to a forward direction, and a direction for sliding the second slider such that the element rows in the engaged state separate is set to a rearward direction.

Further, a lateral direction indicates a tape width direction of the fastener tape, and a left side and a right side at a time of viewing the slide fastener from a front face are respectively set to a left direction and a right direction. An up and down direction indicates a tape back and front direction which is orthogonal to a tape surface of the fastener tape, and a side in which a catch of the slider is arranged with respect to the fastener tape is set to an upward direction, and an opposite side to it is set to a downward direction.

A reverse opening slide fastener 1 in the present embodiment 1 has a pair of first and second fastener stringers 10 and 20 in which element rows 11 and 21 are formed, a first separable connection member 30 (which may be called a box pin) which is arranged continuously from a rear end portion of the element rows 11 in the first fastener stringer 10 in the right side, a second separable connection member 40 (which may be called an insert pin) which is arranged continuously from a rear end portion of the element rows 21 in the second fastener stringer 20 in the left side, and a pair of first and second sliders 50 and 60 which are attached slidably along the element rows 11 of the first fastener stringer 10.

Note that, the first slider 50 is used as a reverse opening slider (a so-called lower slider) which is arranged in a side of the first separable connection member 30, and the second slider 60 is used as a slider (a so-called an upper slider) which is arranged in a side of a stop device 13 mentioned later.

The first and second fastener stringers 10 and 20 respectively have fastener tapes 12 and 22, element rows 11 and 21 which are formed in tape side edge portions of the fastener tapes 12 and 22, and the stop devices 13 and 23 which are firmly fixed to front ends of the element rows 11 and 21 and prevent the second slider 60 from dropping out of the element rows 11 and 21. In this case, the respective fastener tapes 12 and 22 in the left and right sides have core thread portions 14 and 24 in opposing tape end edges.

In the first and second fastener stringers 10 and 20, a plurality of fastener elements 15 and 25 made of a synthetic resin are attached along a tape side edge portion including the core thread portions 14 and 24 of the fastener tapes 12 and 22 by an injection molding so as to be spaced at a fixed distance, whereby the element rows 11 and 21 are formed. Further, reinforcing portions 16 and 26 are formed on tape front and back surfaces in rear end portions of the fastener tapes 12 and 22 by attaching a film made of a resin.

The fastener elements 15 and 25 in the present embodiment 1 are attached to the element attaching portions of the fastener tapes 12 and 22 by injection molding a synthetic resin material such as a polyacetal or the like to a predetermined shape. In the invention, shapes of the fastener elements 15 and 25 are not limited, however, for example, each of the fastener elements has a body portion which is firmly fixed to the fastener tape, a neck portion which extends toward an outer side of the tape from the body portion, and has a shape pinching in the back and forth direction, an engagement head which is provided in a leading end of the neck portion, and a shoulder portion which protrudes in the back and forth direction from the neck portion.

The first separable connection member 30 which is arranged in the first fastener stringer 10 in the right side is firmly fixed over both tape front and back surfaces of the fastener tape 12 continuously from a rear end portion of the element rows 11. The first separable connection member 30 is formed by injection molding a synthetic resin material such as a polyacetal or the like.

Further, the first separable connection member 30 has a main body portion 31 which is firmly fixed to the fastener tape 12, a slider stop portion 32 which is arranged in a rear end portion (a leading end portion) of the main body portion 31, a locking concave portion 33 which can fit a locking convex portion 43 mentioned later of the second separable connection member 40, an accommodating concave portion 34 which is formed in an upper surface side of the main body portion 31 and can accommodate a part of a locking pawl 58 mentioned later of the first slider 50, and an auxiliary locking portion 35 which protrudes out of an opposite side surface opposing to the second separable connection member 40 of the main body portion 31.

The slider stop portion 32 in the first separable connection member 30 is formed larger in a dimension (a thickness) in the up and down direction than the main body portion 31, in such a manner that it can come into contact with upper and lower blades 52 and 53 mentioned later of the first slider 50. The slider stop portion 32 constructs a sliding end in a rear side which stops a sliding motion of the first slider 50 by bringing the first slider 50 into contact.

The locking concave portion 33 is provided so as to be concaved toward an inner side of the tape from an opposite side surface opposing to the second separable connection member 40. In this case, a wall surface portion 33*a* in a rear side which is formed in the locking concave portion 33 is arranged so as to be orthogonal to a tape length direction, and protrudes closer to the side of the second separable connection member 40 than the opposite side surface in the front end side of the main body portion 31, in such a manner that it can stably support a locking convex portion 43 mentioned later of the second separable connection member 40.

Further, the accommodating concave portion 34 in the first separable connection member 30 is formed shallower than the locking concave portion 33 at a position which is closer to a rear side than the locking concave portion 33. The accommodating concave portion 34 can accommodate the locking pawl 58 of the first slider 50, and can prevent the first slider 50 from sliding forward, by bringing the accommodated locking pawl 58 into contact with the wall surface portion 34*a* in the front side which is formed in the accommodating concave portion 34, whereby it is possible to retain the first slider 50 at a predetermined position.

Further, the auxiliary locking portion 35 in the first separable connection member 30 is arranged in a front end portion of the main body portion 31 (a base end portion in a side of the element rows 11), and is provided so as to protrude toward a tape outer side (a left side) from a lower surface side region in the opposite side surface of the main body portion 31. The auxiliary locking portion 35 is formed in such a manner as to form an approximately triangular shape at a time of viewing from a front surface side, and a thickness in the up and down direction in the auxiliary locking portion 35 is set to be approximately one half the thickness of the main body portion 31.

The second separable connection member 40 which is arranged in the second fastener stringer 20 in the left side is firmly fixed over both the tape front and back surfaces of the fastener tape 22 continuously from the rear end portion of the element rows 21. The second separable connection member 40 is also formed by injection molding the synthetic resin material such as the polyacetal or the like, in the same manner as the first separable connection member 30.

Further, the second separable connection member 40 has a main body portion 41 which is firmly fixed to the fastener tape 22, a slider engaging and disengaging portion 42 which is arranged in a rear end portion (a leading end portion) of the main body portion 41, a locking convex portion 43 which protrudes out of an opposite side surface opposed to the first separable connection member 30 of the main body portion 41, an elevated portion 44 which is arranged in an upper surface and a lower surface of the main body portion 41, a guide portion 45 which is arranged in a front end portion of the main body portion 41 (a base end portion in a side of the element rows 11 and 21), an insertion concave portion 46 which is formed in a lower surface side of the main body portion 41 and can insert the auxiliary locking portion 35 of the first separable connection member 30, and a rib portion 47 which is arranged along a side edge in a tape inner side in the main body portion 41.

The slider engaging and disengaging portion 42 in the second separable connection member 40 has a first engaging and disengaging portion 42*a* which is formed thicker than the main body portion 41, and can be locked with shoulder port side end portions of upper and lower flanges 55 and 56 mentioned below of the first slider 50, and a second engaging and disengaging portion 42*b* which is formed thicker than the first engaging and disengaging portion 42*a* and can be locked with shoulder port side end edge portions of upper and lower blades 52 and 53 mentioned below of the first slider 50.

In this case, the first engaging and disengaging portion 42*a* is formed thicker than a gap between the upper and lower flanges 55 and 56, and thinner than a gap between the upper blade 52 and the lower blade 53 in the shoulder port side of the first slider 50. The second engaging and disengaging portion 42*b* is formed thicker than a gap between the upper blade 52 and the lower blade 53 which forms an element guide path 59 of the first slider 50. Further, in this case, since an insertion groove 42*c* which can insert the upper and lower flanges 55 and 56 of the first slider 50 is formed in the first engaging and disengaging portion 42*a*, the second separable connection member 40 can be firmly supported by the slider engaging and disengaging portion 42 with respect to the first slider 50.

Further, the second separable connection member 40 is formed in such a manner as to be rotatable in a state in which it is locked with the first slider 50 while setting the slider engaging and disengaging portion 42 as an axis, a groove width of the insertion groove 42*c* of the slider engaging and disengaging portion 42 is formed in such a manner as to be wider little by little toward a forward side, and a width of the second engaging and disengaging portion 42*b* is formed in such a manner as to be reduced little by little toward a forward side.

The locking convex portion 43 in the second separable connection member 40 is provided so as to protrude toward a tape outer side (a right side) from an upper surface side region in the opposite side surface of the main body portion 41 in such a manner that it is inserted to the locking concave portion 33 formed in the first separable connection member 30 and can be locked. The locking concave portion 43 is formed in such a manner as to be formed an approximately triangular shape at a time of viewing from a front surface side, and a lower end edge of it is orthogonal to the tape length direction. Further, in a rear side than the locking convex portion 43 in the main body portion 41, there is a small notch to the tape inner side (a left side) in such a manner as to prevent from interfering with a rear side wall surface portion 33*a* of the locking concave portion 33 and a forward side wall surface portion 34*a* of the accommodating portion 34 in the first separable connection member 30.

In this case, in the present embodiment 1, the locking concave portion 33 is formed in the first separable connection member 30, and the locking convex portion 43 which can be inserted to the locking concave portion 33 is formed in the second separable connection member 40, however, in the invention, the locking convex portion may be provided in a protruding manner in the first separable connection member, and the locking concave portion which can insert the locking convex portion may be formed in the second separable connection member.

The elevated portion 44 in the second separable connection member 40 is elevated from the upper surface and the lower surface of the main body portion 41. In this case, a height from the main body portion 41 in the elevated portion 44 is set to be smaller than a height from the main body portion 41 in the guide portion 45. The elevated portion 44 has a removal preventing elevated portion 44*a* which is arranged in such a manner as to extend from the guide portion 45, and a position retaining elevated portion 44*b* which is arranged continuously from a rear end of the removal preventing elevated portion 44*a*.

An opposite side surface (a right side surface) which is opposed to the first separable connection member 30 in the removal preventing elevated portion 44*a* is arranged on the same surface as the opposite side surface of the main body portion 41. Further, a width in a lateral direction in the removal preventing elevated portion 44*a* is reduced little by little toward a rear side. The removal preventing elevated portion 44*a* is formed in such a manner as to interfere with the upper and lower flanges 55 and 56 of the first slider 50 at a time of sliding the first slider 50 forward after inserting the second separable connection member 40 to the first and second sliders 50 and 60 as mentioned below. In accordance with this, even if the first slider 50 is separated from the slider engaging and disengaging portion 42 at a time when the first slider 50 slides toward a forward side from a state in which it is retained to the slider engaging and disengaging portion 42 (particularly to the first engaging and disengaging portion 42*a*) of the second separable connection member 40, it is possible to prevent the second separable connection member 40 from removing from the first slider 50.

An opposite side surface (a right side surface) in the position retaining elevated portion 44*b* is arranged on the same surface as the opposite side surface of the main body portion 41. Further, a width in a lateral direction in the position retaining elevated portion 44*b* is increased little by little toward a rear side. Accordingly, a side edge in the tape inner side of a whole of the elevated portion 44 is bent in such a manner as to be concaved to the opposite side surface side at a time of viewing from the front surface side.

The position retaining elevated portion 44*b* is formed in such a manner as to come into contact with the rear port side end portions of the upper and lower flanges 55 and 56 of the first slider 50, at a time of inserting the second separable connection member 40 to the first and second sliders 50 and 60, as mentioned later. In accordance with this, it is possible to retain the second separable connection member 40 at a predetermined position in such a manner that the position of the second separable connection member 40 inserted to the first and second sliders 50 and 60 does not shift to the rear side.

The guide portion 45 in the second separable connection member 40 is arranged in the front end portion of the main body portion 41 at a predetermined magnitude in such a manner that it can go into the element guide path from a shoulder port mentioned later of the second slider 60, at a time of inserting the second separable connection member 40 to the first and second sliders 50 and 60 which are retained to the sliding end portion in the rear side.

The guide portion 45 is formed thicker than the elevated portion 44, and a thickness in the up and down direction in the guide portion 45 is set to the same dimension as a thickness of the fastener element 25, and a thickness of the first engaging and disengaging portion 42*a* in the second separable connection member 40. Further, the guide portion 45 is formed in such a manner that a front half portion of the guide portion 45 has an element shape so that it can be engaged to the fastener element 15 which is arranged in the side closest to the first separable connection member 30 in the element rows 11 of the first fastener stringer 10.

The insertion concave portion 46 in the second separable connection member 40 is provided in a concave manner in a lower surface side in the front end portion of the main body portion 41 in such a manner as to correspond to the auxiliary locking portion 35 of the first separable connection member 30. The auxiliary locking portion 35 of the first separable connection member 30 is inserted to the insertion concave portion 46 at a time of engaging the right and left element rows 11 and 21. In accordance with this, it is possible to prevent a relative position of the first separable connection member 30 and the second separable connection member 40 from being shifted in the up and down direction, at a time of engaging the right and left element rows 11 and 21.

The rib portion 47 in the second separable connection member 40 is arranged in the upper surface and the lower surface of the main body portion 41 in such a manner as to reinforce the second separable connection member 40 and easily grip by picking the second separable connection member 40. In this case, a space between the elevated portion 44 of the rib portion 47 in the second separable connection member 40 comes to a passage on which the upper and lower flanges of the first slider 50 travel at a time when the first slider 50 slides.

In this case, the main body portion 41 has the same thickness (dimension in the up and down direction) continuously from the space between the elevated portion 44 and the rib portion 47 to the space (the insertion groove 42*c*) between the rib portion 47 and the slider engaging and disengaging portion 42, and the front and back surfaces of the main body portion 41 are formed flat.

The first and second sliders 50 and 60 respectively have slider bodies 51 and 61, and catches 51*a* and 61*a*. The slider bodies 51 and 61 have upper blades 52 and 62, lower blades 53 and 63, connecting posts 54 and 64 which connects the upper and lower blades 52, 53, 62 and 63 by a slider end portion, upper flanges 55 and 65 which are provided so as to be hanged from left and right side edges of the upper blades 52 and 62, lower flanges 56 and 66 which are provided so as to be hanged from left and right side edges of the lower blades 53 and 63, catch attaching posts 57 and 67 which are provided in a rising manner on upper surfaces of the upper blades 52 and 62, and locking pawls 58 and 68 which are arranged in the upper blades 52 and 62. The catches 51*a* and 61*a* are rotatably attached to the catch attaching posts 57 and 67.

In this case, a distance between the upper and lower blades 52, 53, 62 and 63 in the first and second sliders 50 and 60 is set to be smaller than the thickness of the slider stop portion 32 in the first separable connection member 30, and the thickness of the second engaging and disengaging portion 42*b* in the second separable connection member 40.

Further, the shoulder ports are formed in the right and left of the end portion in the side in which the connecting posts 54 and 64 of the slider bodies 51 and 61 are arranged, and the rear port is formed in an end portion in an opposite side to it. Element guide paths 59 and 69 which communicate the right and left shoulder ports and the rear port and are formed into an approximately Y-shape are provided within the slider bodies 51 and 61.

In this case, the locking pawls 58 and 68 of the first and second sliders 50 and 60 are constructed by an elastic member, and parts of the locking pawls 58 and 68 are protruded into the element guide paths 59 and 69 in a state in which the first and second sliders 50 and 60 are not operated, as shown in FIG. 5. Further, since the catches 51*a* and 61*a* are drawn at a time of operating the first and second sliders 50 and 60, the locking pawls 58 and 68 are lifted upward by the catches 51*a* and 61*a*, and it is possible to retract the parts of the locking pawls 58 and 68 under protruding from the element guide paths 59 and 69.

Since the first and second sliders 50 and 60 have the locking pawls 58 and 68 mentioned above, the parts of the locking pawls 58 and 68 protrude to the element guide paths 59 and 69 so as to be locked with the element rows 11 and 21 at a time of stopping the first slider 50 or the second slider 60 at an optional position of the element rows 11 and 21. Accordingly, it is possible to retain the first slider 50 or the second slider 60 at the stopped position.

In the present embodiment 1, the first slider 50 and the second slider 60 are slidably attached to the element rows of the first stringer 10 in such a direction that the mutual rear ports are opposed to each other. Further, the first slider 50 is arranged in a side which is closer to the first separable connection member 30 than the second slider 60.

Further, in the present embodiment 1, a distance 71 between the upper and lower flanges 55 and 56 of the first slider 50 and a distance between the upper and lower flanges 65 and 66 of the second slider 60 are set to magnitudes which are different from each other. Specifically, the distance 71 between the upper and lower flanges 55 and 56 of the first slider 50 is set to be larger than the distance 72 between the upper and lower flanges 65 and 66 of the second slider 60.

Further, the distance 71 in the first slider 50 is set to be larger than a thickness 73 of the main body portion 31 in the second separable connection member 40, and smaller than thicknesses 74 and 75 of the first engaging and disengaging portion 42*a* and the elevated portion 44 in the second separable connection member 40.

On the other hand, the distance 72 between the upper and lower flanges 65 and 66 of the second slider 60 is set to be larger than the thicknesses 73 and 75 of the main body portion 31 and the elevated portion 44 in the second separable connection member 40, and smaller than the thickness 74 of the first engaging and disengaging portion 42*a* in the second separable connection member 40.

Further, since the distances 71 and 72 between the upper and lower flanges 55, 56, 65 and 66 of the first and second sliders 50 and 60 have the relationship mentioned above with respect to the second separable connection member 40, it is possible to insert the second separable connection member 40 to the first and second sliders 50 and 60 via the gaps between the upper and lower flanges 55, 56, 65 and 66 of the first and second sliders 50 and 60.

In this case, the second separable connection member 40 has an inserting and removing region in which it can be inserted into the first and second sliders 50 and 60 via the gaps between the upper and lower flanges 55, 56, 65 and 66 of the first and second sliders 50 and 60 in a state in which the first and second sliders 50 and 60 are retained to the sliding end portion in the side of the first separable connection member 30, and can be removed from the first and second sliders 50 and 60. The inserting and removing region as mentioned above includes a part of the main body portion 31 and a part of the elevated portion 44 in the second separable connection member 40, and the removal preventing elevated portion 44*a* is particularly arranged within the inserting and removing region in which it is inserted into and removed from the second slider 60.

In this case, in the present embodiment 1, the distances 71 and 72 between the upper and lower flanges 55, 56, 65 and 66 of the first and second sliders 50 and 60 are set to be smaller than the thicknesses of the fastener elements 15 and 25, and the thickness of the main body portion 31 of the first separable connection member 30. Accordingly, the first and second sliders 50 and 60 are not detached from the first fastener stringer 10.

In the reverse opening slide fastener 1 of the present embodiment 1 mentioned above, a retaining structure for retaining the first slider 50 to the sliding end portion in the side of the first separable connection member 30 is constructed by the locking pawl 58 of the first slider 50, and the accommodating concave portion 34 which is formed in the first separable connection member 30.

Further, it is preferable that a positioning structure for carrying out a relative positioning of the second separable connection member 40 with respect to the first separable connection member 30 at a time of inserting the second separable connection member 40 to the first and second sliders 50 and 60 is constructed by the retaining structure mentioned above (that is, the locking pawl 58 of the first slider 50 and the accommodating concave portion 34 of the first separable connection member 30), and the slider engaging and disengaging portion 42 of the second separable connection member 40, as shown in the present embodiment.

Next, a description will be given of a case that the first and second fastener stringers 10 and 20 are closed by engaging the left and right element rows 11 and 21 from the state in which the first and second fastener stringers 10 and 20 are separated, with regard to the reverse opening slide fastener 1 in accordance with the present embodiment 1 having the structure mentioned above, with reference to FIGS. 6 to 11. Note that, in FIGS. 6 to 11, in order to clearly understand the relationship of the first and second separable connection members 30 and 40, the first and second sliders 50 and 60 are shown by a virtual line.

First of all, the first slider 50 and the second slider 60 are slid toward the rear side along the element rows 11 of the first stringer 10. At this time, the first slider 50 is moved to a position of the sliding end portion at which the shoulder port side end portions of the upper and lower blades 52 and 53 come into contact with the slider stop portion 32 of the first separable connection member 30, and the second slider 60 is moved to a position at which the rear port side end portions of the upper and lower blades 62 and 63 come into contact with the first slider 50.

Further, in the first slider 50 which moves to the sliding end portion, a part of the locking pawl 58 is accommodated in the accommodating concave portion 34 of the first separable connection member 30 by making a part of the locking pawl 58 of the first slider 50 protrude to the element guide path 59. In accordance with this, the first slider 50 is retained (temporarily fixed) at the position of the sliding end portion in the side of the first separable connection member 30.

Figure 6:
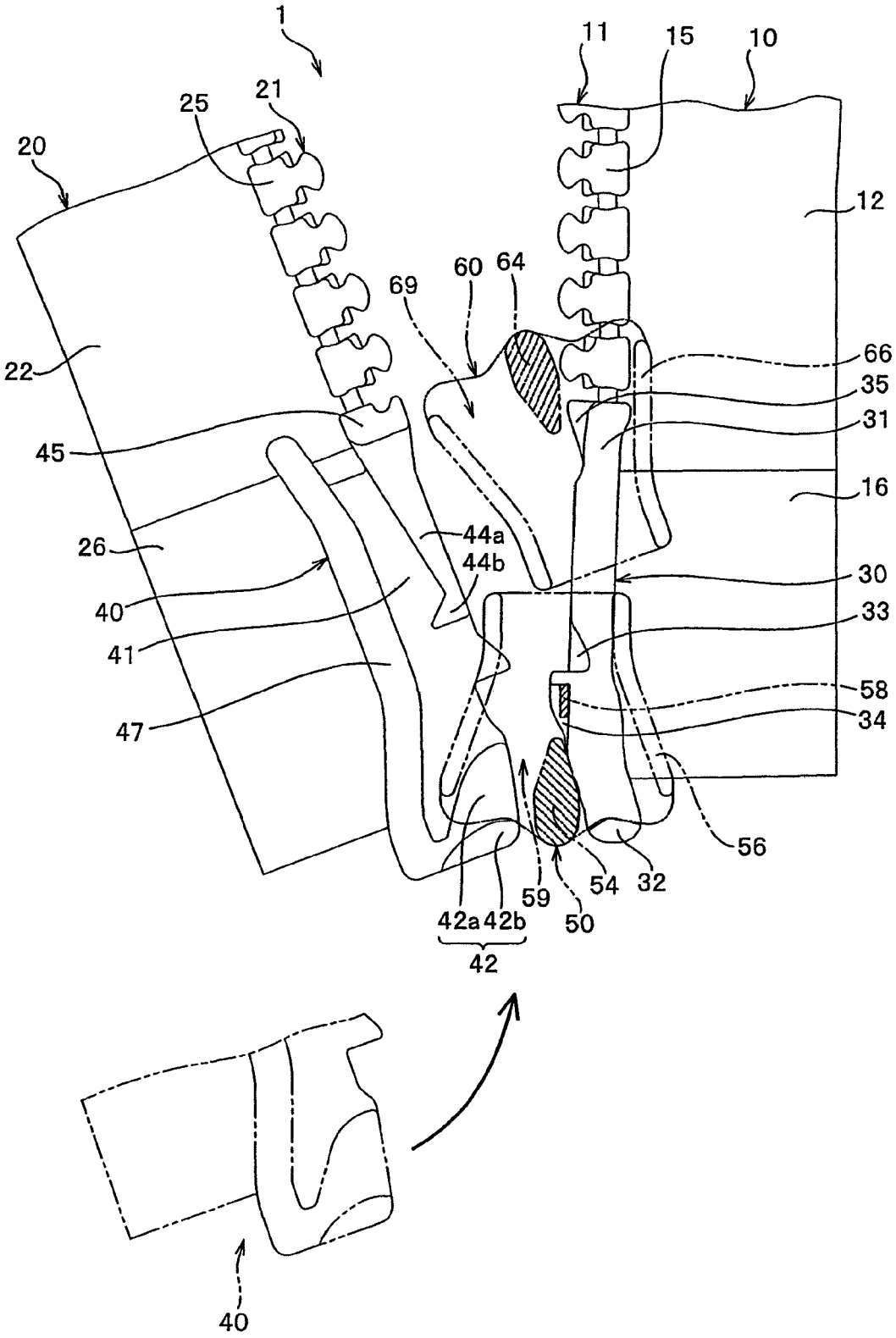
FIG. 6 is an explanatory view explaining an operation for locking a slider engaging and disengaging portion of the second separable connection member with a shoulder port side end portion of the first slider.

After the first and second sliders 50 and 60 move to the positions of their respective sliding end portions as mentioned above, the second separable connection member 40 of the second fastener stringer 20 is moved from a leftward diagonally rear side of the first slider 50, as shown in FIG. 6. Further, a part of the main body portion 31 of the second separable connection member 40 is inserted into the element guide path 59 via the gap between the upper and lower flanges 55 and 56 of the first slider 50, and the second engaging and disengaging portion 42*b* of the second separable connection member 40 is locked with (caught on) the shoulder port side end edge portions of the upper and lower blades 52 and 53 of the first slider 50. In accordance with this, it is possible to position the second separable connection member 40 at the predetermined position with respect to the first slider 50 and the first separable connection member 30.

Next, the second separable connection member 40 locked with the first slider 50 by the second engaging and disengaging portion 42*b* is rotated in a clockwise direction as seen from the front surface side (an inserting direction) around a portion at which the second engaging and disengaging portion 42*b* comes into contact with the first slider 50. At this time, the thickness 73 of the inserting and removing region (the main body portion 31) which is inserted to the first slider 50 of the second separable connection member 40 is set to be smaller than the distance 71 between the upper and lower flanges 55 and 56 of the first slider 50, and the thickness 75 of the inserting and removing region (the elevated portion 44) which is inserted to the second slider 60 of the second separable connection member 40 is set to be smaller than the distance 72 between the upper and lower flanges 65 and 66 of the second slider 60.

Figure 7:
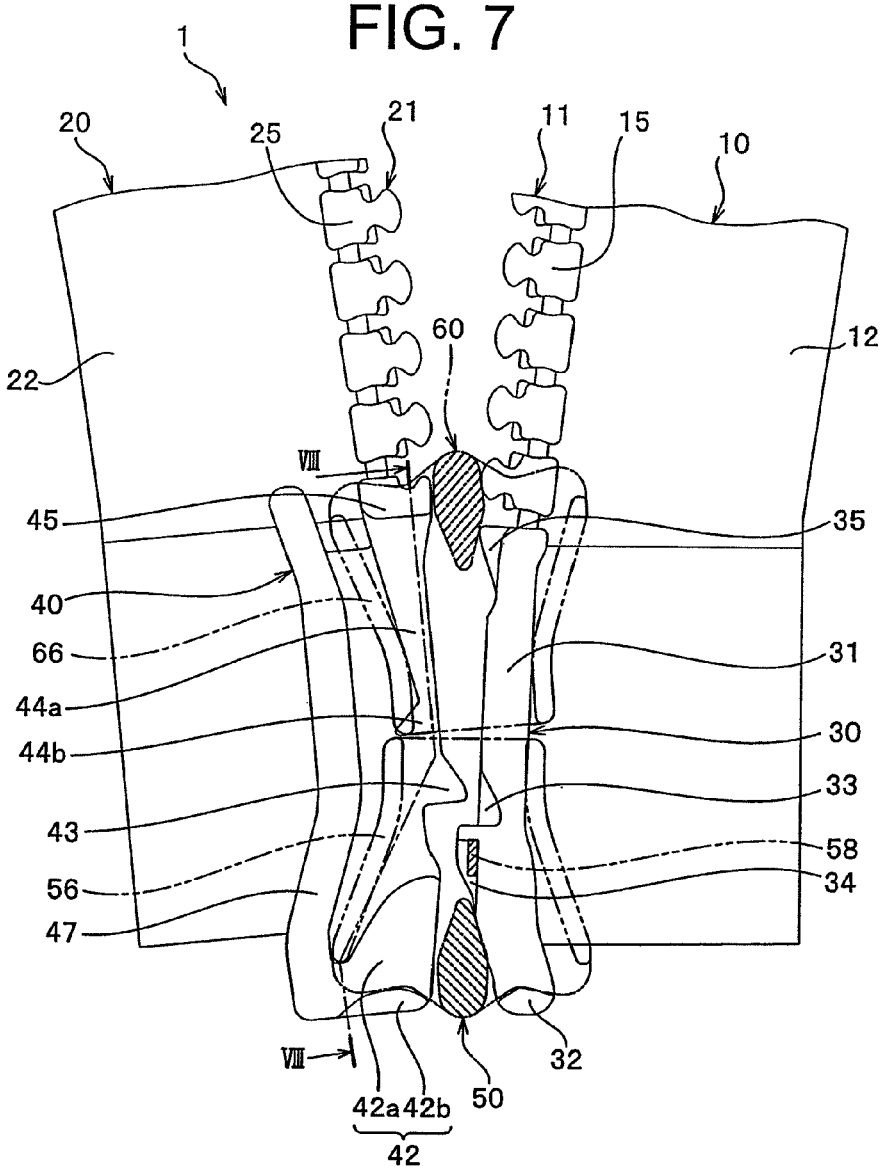
FIG. 7 is a schematic view showing a state in which the second separable connection member is inserted to the first and second sliders.
Figure 8:
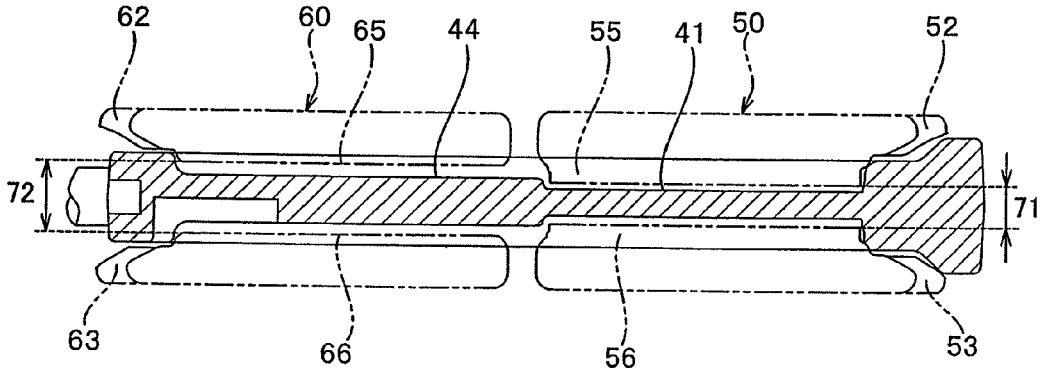
FIG. 8 is a cross-sectional view along a bent line VII-VII in FIG. 7.

Accordingly, by rotating the second separable connection member 40 in the clockwise direction (the inserting direction), it is possible to lock the first engaging and disengaging portion 42*a* of the second separable connection member 40 with the shoulder port side end portions of the upper and lower flanges 55 and 56 of the first slider 50, and it is possible to easily insert the inserting and removing region of the second separable connection member 40 into the element guide paths 59 and 69 via the gaps between the upper and lower flanges 55, 56, 65 and 66 of the first and second sliders 50 and 60, as shown in FIGS. 7 and 8.

Further, in this case, since the first and second sliders 50 and 60 are positioned in the sliding end portion in the side of the first separable connection member 30, it is possible to insert the guide portion 45 of the second separable connection member 40 into the element guide path 69 from the shoulder port of the second slider 60 at a time of rotating the second separable connection member 40 so as to insert the inserting and removing region of it into the first and second sliders 50 and 60. In the case that the second slider 60 does not move to the sliding end portion in the side of the first separable connection member 30 at this time, it is impossible to make the guide portion 45 go into the element guide path 69 from the shoulder port of the second slider 60 even by rotating the second separable connection member 40.

In other words, in the revere opening slide fastener 1 in accordance with the present embodiment 1, by rotating the second separable connection member 40 so as to make the guide portion 45 of the second separable connection member 40 go into the element guide path 69 from the shoulder port of the second slider 60, it is possible to make the user check out that the second slider 60 is arranged at the predetermined position of the sliding end portion. Further, since the guide portion 45 is arranged at the predetermined magnitude in the front end portion of the second separable connection member 40, it is possible to make the user check out that the second separable connection member 40 is rotated to the predetermined position which can slide the second slider 60, at a time when the guide portion 45 is moved and accommodated into the element guide path 69 of the second slider 60.

Further, in the present embodiment 1, it is possible to insert the second separable connection member 40 while bringing the position retaining elevated portion 44*b* of the second separation connection member 40 into contact with the rear port side end portions of the upper and lower flanges 55 and 56 of the first slider 50, at a time of rotating the second separable connection member 40 so as to insert into the first and second sliders 50 and 60. By bringing the position retaining elevated portion 44*b* of the second separable connection member 40 into contact with the first slider 50 as mentioned above, it is possible to easily carry out the positioning in such a manner as to prevent the position of the second separable connection member 40 from being shifted to the rear side with respect to the first separable connection member 30 and the first slider 50.

By rotating the second separable connection member 40 as mentioned above, it is possible to easily insert the second separable connection member 40 until the guide portion 45 is accommodated within the element guide path 69 of the second slider 60 and the second separable connection member 40 comes into contact with the connecting post 64 of the second slider 60, as shown in FIG. 7.

After the second separable connection member 40 is sufficiently inserted, the second slider 60 is successively slid toward the forward direction. Since the fastener element 15 of the first fastener stringer 10 and the fastener element 25 of the second fastener stringer 20 are moved in the engaging direction by sliding the second slider 60 forward, it is possible to rotate the second separable connection member 40 in such a manner as to be closer to the first separable connection member 30.

In accordance with this, it is possible to insert the locking convex portion 43 of the second separable connection member 40 into the locking concave portion 33 of the first separable connection member 30 so as to lock, whereby it is possible to prevent the position of the second separable connection member 40 from being shifted to the rear side with respect to the first separable connection member 30 and the first slider 50.

In this case, since the second separable connection member 40 rotates and the position retaining elevated portion 44*b* of the second separable connection member 40 moves to the first separable connection member 30 side at a time when the locking convex portion 43 of the second separable connection member 40 is inserted into the locking concave portion 33 of the first separable connection member 30 as mentioned above, the state in which the position retaining elevated portion 44*b* comes into contact with the first slider 50 is released.

In other words, in the present embodiment 1, the position retaining elevated portion 44*b* of the second separable connection member 40 comes into contact with the first slider 50, thereby preventing the displacement of the second separable connection member 40 until the locking convex portion 43 of the second separable connection member 40 is inserted into the locking concave portion 33 of the first separable connection member 30 on the basis of the sliding motion of the second slider 60 after inserting the second separable connection member 40 into the first and second sliders 50 and 60. Further, after the locking convex portion 43 of the second separable connection member 40 is inserted into the locking concave portion 33 of the first separable connection member 30 (or just before being inserted), the locking convex portion 43 is locked with the locking concave portion 33, thereby preventing the displacement of the second separable connection member 40.

Figure 9:
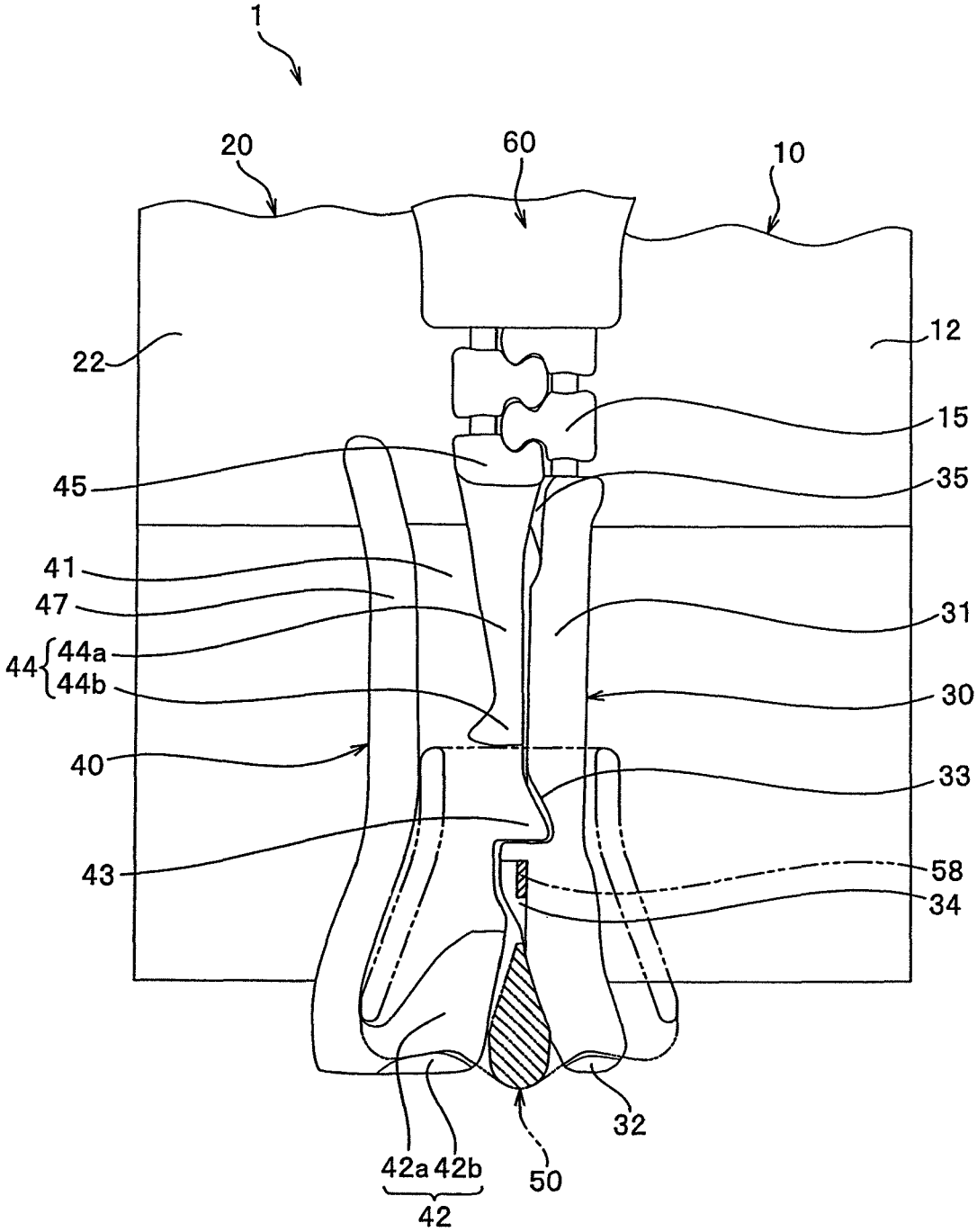
FIG. 9 is a schematic view showing a state in which right and left element rows are engaged by sliding the second slider.

Thereafter, by sliding the second slider 60 further forward, the guide portion 45 of the second separable connection member 40 is engaged to the fastener element 15 which is arranged in the most rearward side of the element rows 11 of the first fastener stringer 10, and the left and right element rows 11 and 21 are engaged in this order from the rear end portion as shown in FIG. 9. In accordance with this, it is possible to smoothly close the first and second fastener stringers 10 and 20.

In the case that the first and second fastener stringers 10 and 20 are in the closed state, the first engaging and disengaging portion 42*a* of the second separable connection member 40 is locked with the upper and lower flanges 55 and 56 of the first slider 50. Accordingly, it is possible to prevent the second separable connection member 40 from removing from the first slider 50. In accordance with this, even if the first and second fastener stringers 10 and 20 are exposed to a transverse pulling force pulling them in a direction of pulling away from each other, for example, in a state in which the first slider 50 is retained to the first separable connection member 30, the first and second separable connection member 40 does not remove from the first slider 50, and it is possible to prevent the engaging of the fastener elements 15 and 25 from being disconnected from the rear end sides of the left and right element rows 11 and 21 (a engaging crack from being generated).

Further, after closing the first and second fastener stringers 10 and 20 as mentioned above, for example, in the case of separating the left and right element rows 11 and 21 in the engaged state from the rear end portion side, the locking pawl 58 of the first slider 50 is retracted from the accommodating concave portion 34 of the first separable connection member 30 by pulling the catch 51*a* of the first slider 50 which is retained to the first separable connection member 30, and the first slider 50 is slid forward.

Figure 10:
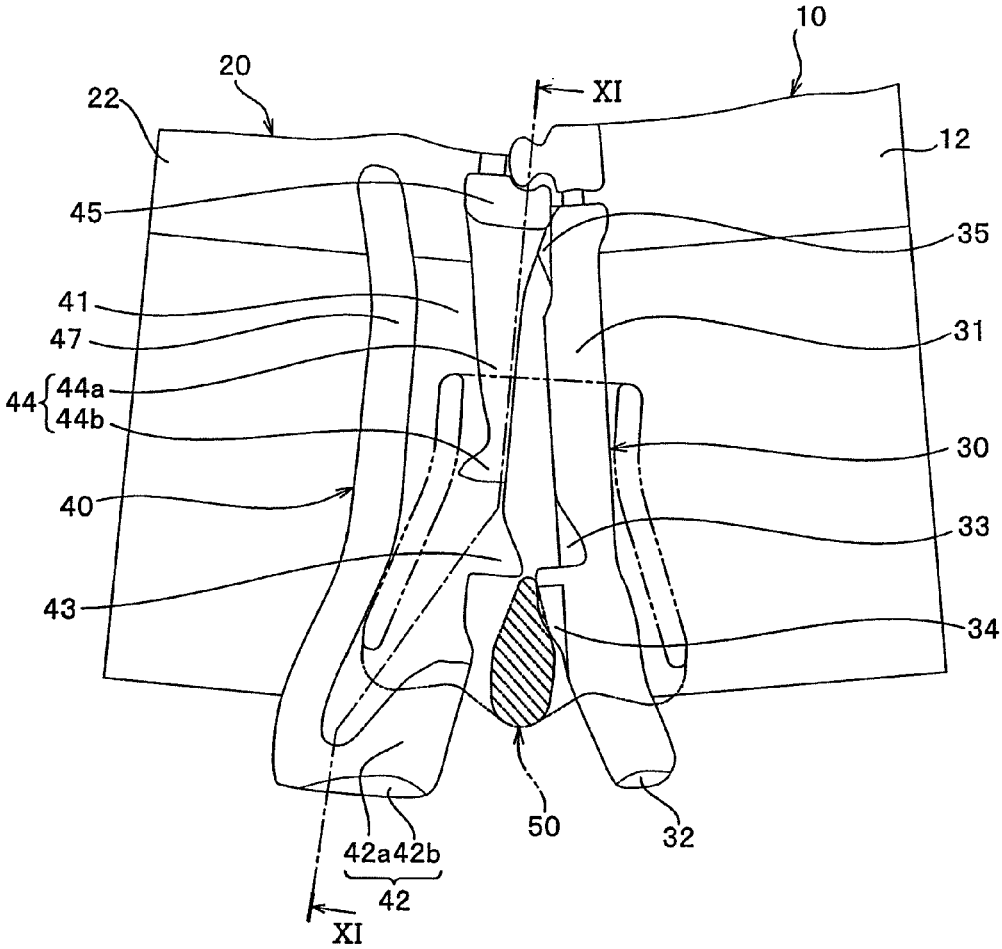
FIG. 10 is a schematic view showing a state at a time of sliding the second slider.

At this time, the wall surface portion 33*a* in the rear side which is formed in the locking concave portion 33 of the first separable connection member 30 is formed so as to protrude to the side of the second separable connection member 40 as mentioned above. Accordingly, the first slider 50 starts sliding forward, and as shown in FIG. 10, the first slider 50 rotates in the clockwise direction on the basis of the interference between the connecting post 54 of the first slider 50 and the wall surface portion 33*a* in the first separable connection member 30, and the posture of the first slider 50 is inclined with respect to the tape length direction.

In this case, in the present embodiment 1, the distance 71 between the upper and lower flanges 55 and 56 of the first slider 50 is set to be smaller than the thickness 75 of the elevated portion 44 of the second separable connection member 40 as mentioned above, and the side edge in the tape inner side in the elevated portion 44 is bent in such a manner as to be concaved to the opposite side surface side.

Accordingly, since the width in the connecting portion between the removal preventing elevated portion 44*a* and the position retaining elevated portion 44*b* becomes the smallest, the first slider 50 can prevent the upper and lower flanges 55 and 56 from catching on the elevated portion 44 of the second separable connection member 40 by utilizing the concave portion in the side edge in the tape inner side of the elevated portion 44, and can smoothly slide toward the forward side, even if the posture of the first slider 50 is tilted on the basis of the interference between the connecting post 54 of the first slider 50 and the wall surface portion 33*a* of the first separable connection member 30 as mentioned above.

Further, if the connecting post 54 of the first slider 50 goes over the wall surface portion 33*a* in the first separable connection member 30, and the interference between the connecting post 54 and the wall surface portion 33*a* is released, the first slider 50 rotates in a counter-clockwise direction and slides forward while turning back its posture.

In this case, in the present embodiment 1, the locked state between the slider engaging and disengaging portion 42 of the second separable connection member 40 and the first slider 50 is released at a time of sliding the first slider 50 forward as mentioned above from the sliding end portion in the side of the first separable connection member 30, however, the elevated portion 44 of the second separable connection member 40 is inserted into the element guide paths 59 and 69 of the first slider 50 at the same time when the locked state is released.

Figure 11:
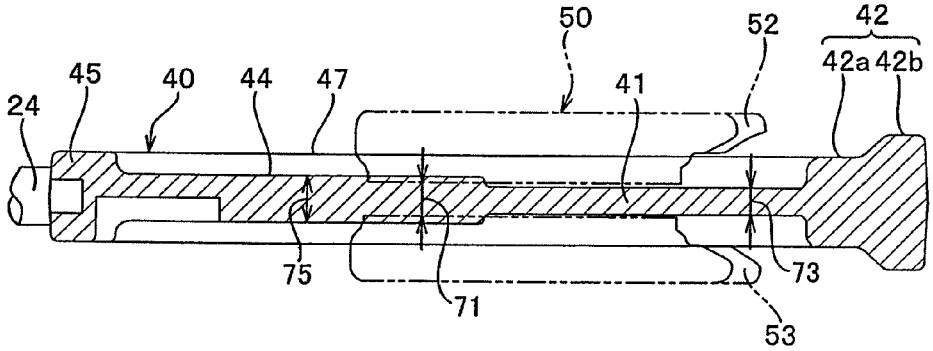
FIG. 11 is a cross-sectional view along a bent line XI-XI in FIG. 10.

In this case, the thickness 75 of the elevated portion 44 of the second separable connection member 40 is set to be larger than the distance 71 between the upper and lower flanges 55 and 56 of the first slider 50, as shown in FIG. 11. Therefore, even if the first and second fastener stringers 10 and 20 are exposed to the transverse pulling force, for example, at a time when the first slider 50 slides on the first and second separable connection members 30 and 40, the elevated portion 44 of the second separable connection member 40 comes into slidably contact with the upper and lower flanges 55 and 56 of the first slider 50. Accordingly, the second separable connection member 40 does not remove from the first slider 50.

Thereafter, since the left and right element rows 11 and 21 are introduced into the element guide path 59 from the rear port side of the first slider 50 by sliding the first slider 50, it is possible to release the engagement of the left and right element rows 11 and 21, and for example, as shown in FIG. 1, it is possible to easily open the first and second fastener stringers 10 and 20 from the rear end side.

Next, a description will be given of the case that the reverse opening slide fastener 1 is opened by completely separating the first and second fastener stringers 10 and 20 from the state in which the left and right element rows 11 and 21 are engaged at least partly as shown in FIG. 1, in the reverse opening slide fastener 1 in accordance with the present embodiment 1.

First of all, the first and second sliders 50 and 60 are slid toward the rear side along the element rows 11 and 21, and the first and second sliders 50 and 60 are retained at the position of the sliding end portion. At this time, since the first slider 50 moves to the position of the sliding end portion, the slider engaging and disengaging portion 42 of the second separable connection member 40 is locked with the first slider 50.

Further, since the second slider 60 moves to the position of the sliding end portion, the guide portion 45 of the second separable connection member 40 is guided in a direction of moving away from the first separable connection member 30 by the connecting post 64 of the second slider 60. In accordance with this, the second separable connection member 40 locked with the first slider 50 rotates a little in the counter-clockwise direction (the removing direction) as seen from the front surface side. At this time, the reverse opening slide fastener 1 comes to a state shown in FIG. 7.

Thereafter, the second separable connection member 40 is rotated in the counter-clockwise direction (the removing direction) around the portion at which the second engaging and disengaging portion 42*b* of the second separable connection member 40 comes into contact with the first slider 50. In accordance with this, it is possible to remove the inserting and removing region of the second separable connection member 40 from the first and second sliders 50 and 60 via the gaps 71 and 72 between the upper and lower flanges 55, 56, 65 and 66 of the first and second sliders 50 and 60, while removing the guide portion 45 of the second separable connection member 40 which is inserted into the element guide path 69 of the second slider 60, from the shoulder port of the second slider 60.

Further, since the second separable connection member 40 is removed completely from the first and second sliders 50 and 60 by moving the second separable connection member 40 leftward diagonally rearward with respect to the first slider 50, after the guide portion 45 of the second separable connection member 40 is removed from the second slider 60, it is possible to separate the first fastener stringer 10 and the second fastener stringer 20.

As mentioned above, in the reverse opening slide fastener 1 in accordance with the present embodiment 1, in the case of closing the separated left and right first and second fastener stringers 10 and 20, the second separable connection member 40 is rotated after locking the second separable connection member 40 with the first slider 50 so as to position. In accordance with this, it is possible to insert the second separable connection member 40 into the first and second sliders 50 and 60 from the gaps 71 and 72 between the upper and lower flanges 55, 56, 65 and 66 of the first and second sliders 50 and 60.

Accordingly, in accordance with the reverse opening slide fastener 1, for example as seen in the conventional reverse opening slide fastener, it is not necessary to insert the second separable connection member into the element guide path via the shoulder port of the second slider, it is possible to easily and stably insert the second separable connection member 40 into the predetermined position within the first and second sliders 50 and 60.

Accordingly, it is possible to reduce a possibility that the insertion of the second separable connection member 40 with respect to the first and second sliders 50 and 60 becomes insufficient, and it is possible to reduce the problems that the second slider 60 is pulled by force so as to break the slide fastener, and the like.

Further, in accordance with the reverse opening slide fastener 1, since it is possible to remove the second separable connection member 40 via the gaps 71 and 72 between the upper and lower flanges 55, 56, 65 and 66 of the first and second sliders 50 and 60, even at a time of removing the second separable connection member 40 from the first and second sliders 50 and 60, it is possible to smoothly carry out the separating operation of the first and second fastener stringers 10 and 20. Accordingly, it is possible to significantly improve an operability of the connection and separation operation of the reverse opening slide fastener 1.

In this case, since the gaps 71 and 72 between the upper and lower flanges 55, 56, 65 and 66 are different from each other in the first slider 50 and the second slider 60 in accordance with the embodiment 1 mentioned above, it is impossible to employ the slider having the same shape for the first slider 50 and the second slider 60. Accordingly, there can be thought that the second slider 60 is attached to the side closer to the first separable connection member 30 than the first slider 50 by getting the positional relationship between the first slider 50 and the second slider 60 wrong, for example, at a time of assembling the reverse opening slide fastener 1 in accordance with the embodiment 1.

If the attachment of the first slider 50 and the second slider 60 is got wrong, it is impossible to insert the second separable connection member 40 into the first and second sliders 50 and 60 on the basis of the relationship between the gaps 71 and 72 between the upper and lower flanges 55, 56, 65 and 66 of the first and second sliders 50 and 60, and the thickness of the second separable connection member 40, and there can be thought that it can not serve as the slide fastener.

Figure 12:
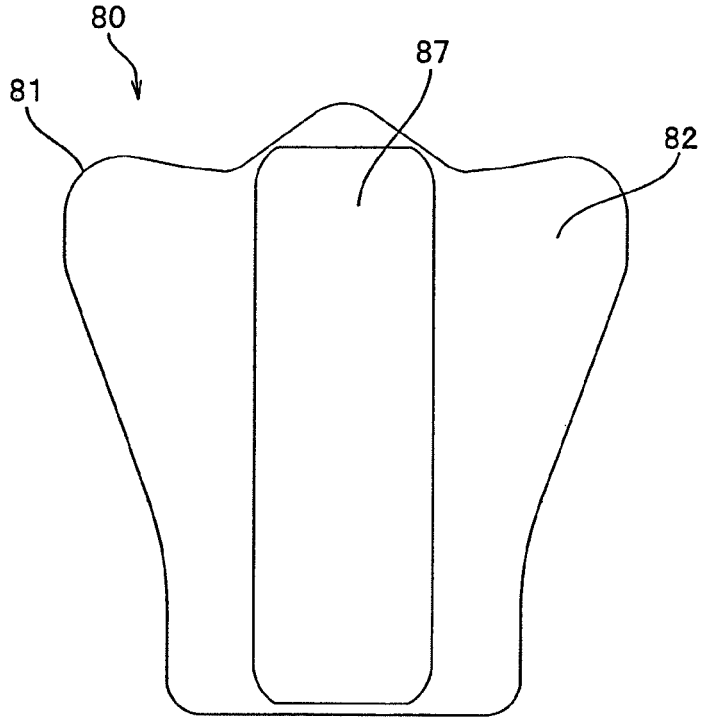
FIG. 12 is a front view showing first and second sliders in accordance with a modified example of the embodiment 1.
Figure 13:
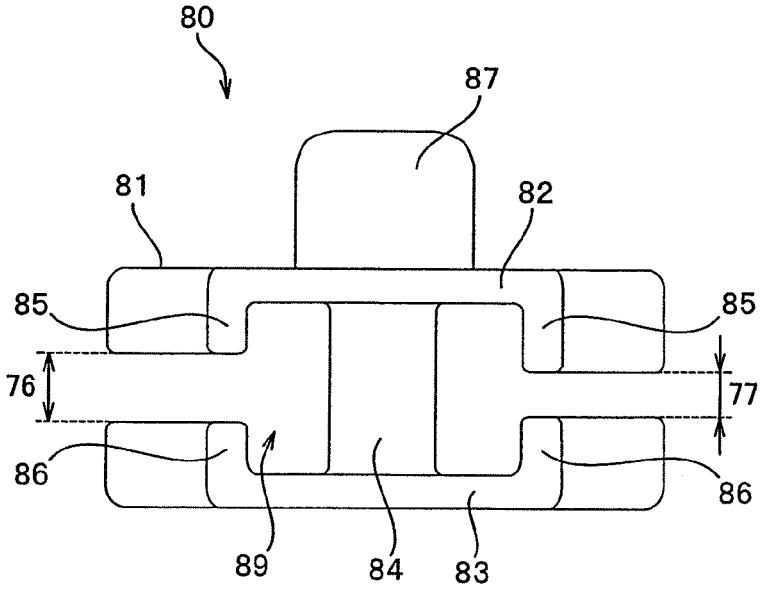
FIG. 13 is a schematic view at a time of viewing the first and second sliders in accordance with the modified example from a rear port side.

Accordingly, in order to dissolve the problem mentioned above, in the invention, a slider 80 in accordance with a modified example shown in FIGS. 12 and 13 can be used as the first and second sliders 50 and 60 of the reverse opening slide fastener 1.

In this case, a description will be given particularly of the slider in FIGS. 12 and 13. The slider 80 has a slider body 81, and a catch (not shown) which is the same as the embodiment 1 mentioned above. The slider body 81 has an upper blade 82, a lower blade 83, a connecting post 84 which connects the upper and lower blades 82 and 83 by a slider end portion, an upper flange 85 which is provided so as to be hanged from right and left side edges of the upper blade 82, a lower flange 86 which is provided so as to rise from right and left side edges of the lower blade 83, a catch attaching post 87 which is provided in a rising manner on an upper surface of the upper blade 82, and a locking pawl (not shown) which is arranged in the upper blade 82.

Further, a shoulder port is formed right and left in an end portion in a side in which the connecting post 84 of the slider body 81 is arranged, and a rear port is formed in an end portion in an opposite side. An element guide path 89 which communicates the right and left shoulder ports and the rear port and is formed into an approximately Y-shape is provided within the slider body 81.

Further, in the slider 80, for example, at a time of viewing the slider body 81 from the rear port side (refer to FIG. 13), a distance 76 between the upper and lower flanges 85 and 86 in the left side is set to be larger than a distance 77 between the upper and lower flanges 85 and 86 in the right side. In this case, the distance 76 between the upper and lower flanges 85 and 86 in the left side is set to be larger than the thicknesses 73 and 75 of the main body portion 31 and the elevated portion 44 in the second separable connection member 40, and be smaller than the thickness of the first engaging and disengaging portion 42*a* in the second separable connection member 40.

Further, the distance 77 between the upper and lower flanges 85 and 86 in the right side is set to be larger than the thickness 73 of the main body portion 31 in the second separable connection member 40, and be smaller than the thicknesses 74 and 75 of the first engaging and disengaging portion 42*a* and the elevated portion 44 in the second separable connection member 40.

Two sliders 80 having the shape mentioned above can be used as the first and second sliders in the reverse opening slide fastener 1 in accordance with the embodiment 1 mentioned above by being attached to the element rows 11 and 21 of the first fastener stringer 10 in such a direction that the rear ports are opposed.

In accordance with this, it is possible to easily insert the inserting and removing region of the second separable connection member 40 into the element guide path 89 via the gaps 77 and 76 between the upper and lower flanges 85 and 86 of the first and second sliders 80 and 80 by rotating the second separable connection member 40 in the inserting direction after locking the second separable connection member 40 with the first slider 80 (for example, refer to FIG. 6). Further, even at a time of removing the second separable connection member 40 from the first and second sliders 80 and 80, it is possible to easily remove the second separable connection member 40 via the gaps 77 and 76 between the upper and lower flanges 85 and 86 of the first and second sliders 80 and 80.

Further, in this case, since the slider having the same shape can be employed for the first slider 80 and the second slider 80, there will be no erroneous attachment of the first slider 80 and the second slider 80 at a time of assembling the reverse opening slide fastener. Accordingly, it is possible to easily and stably assemble the reverse opening slide fastener 1 which functions normally.

Note that, in the reverse opening slide fastener 1 in accordance with the embodiment 1 mentioned above, the second separable connection member 40 in which the operation for inserting to the first and second sliders 50 and 60 is carried out is constructed as a so-called left inserting type reverse opening slide fastener 1 which is arranged in the second fastener stringer 20 in the left side.

However, the reverse opening slide fastener in accordance with the invention is not limited to this, but, for example, the second separable connection member in which the operation for inserting into the first and second sliders is carried out can be constructed as a so-called right inserting type reverse opening slide fastener which is attached to the second fastener stringer in the right side.

Figure 14:
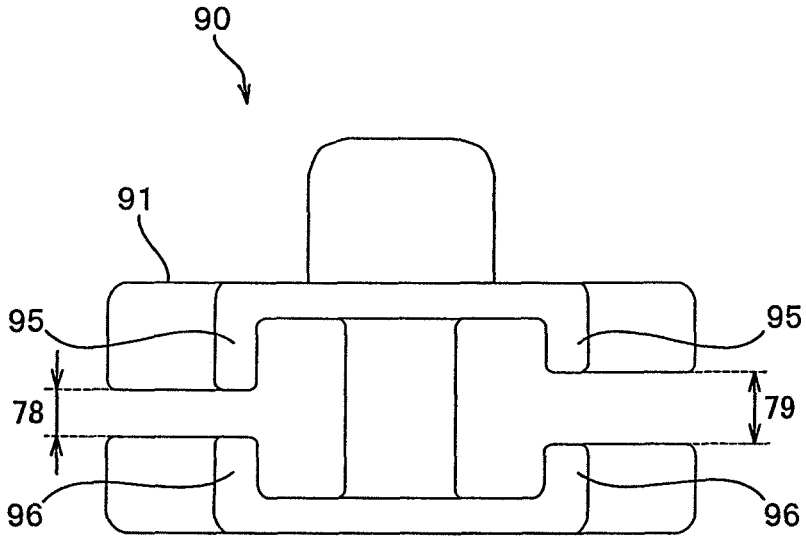
FIG. 14 is a schematic view showing first and second sliders used in a reverse opening slide fastener in which a second separable connection member is inserted from right sides of the first and second sliders.

Further, for example, in the case that the reverse opening slide fastener is constructed as the right inserting type, in order to prevent the erroneous attachment of the first slider and the second slider at a time of assembling the reverse opening slide fastener, a slider 90 which is shown in FIG. 14 and has the same shape can be used as the first and second sliders.

In the slider shown in FIG. 14, for example, at a time of viewing a slider body 91 from a rear port side, a distance 78 between upper and lower flanges 95 and 96 in a left side is set to be larger than a distance 79 between upper and lower flanges 95 and 96 in a right side. Further, the distance 78 between the upper and lower flanges 95 and 96 in the left side is set to be larger than the thickness 73 of the main body portion 31 in the second separable connection member 40, and be smaller than the thicknesses 74 and 75 of the first engaging and disengaging portion 42*a* and the elevated portion 44 in the second separable connection member 40. Further, the distance 79 between the upper and lower flanges 95 and 96 in the right side is set to be larger than the thicknesses 73 and 75 of the main body portion 31 and the elevated portion 44 in the second separable connection member 40, and be smaller than the thickness of the first engaging and disengaging portion 42*a* in the second separable connection member 40.

Embodiment 2

Figure 15:
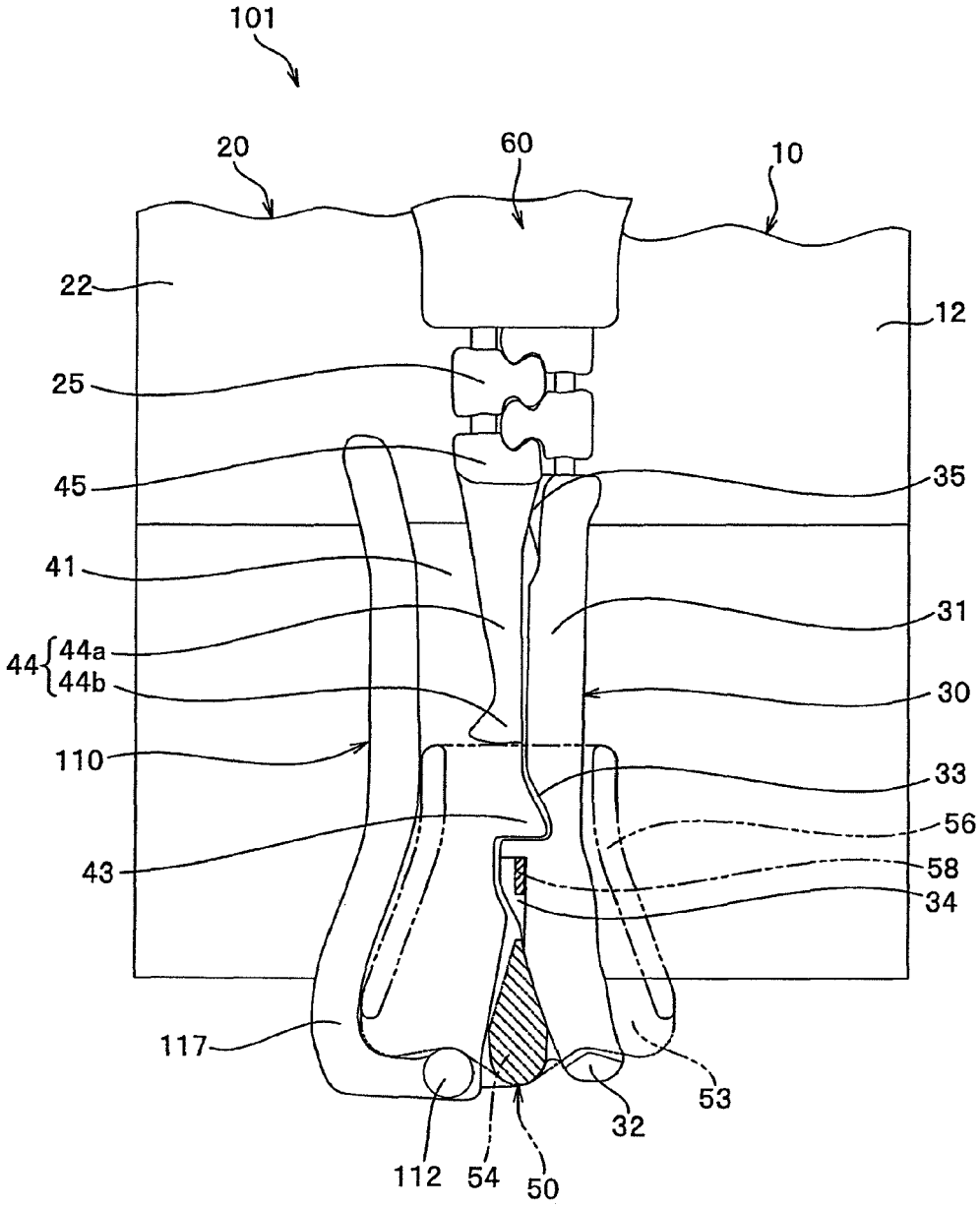
FIG. 15 is a front view showing a substantial part of a reverse opening slide fastener in accordance with embodiment 2 of the invention.

FIG. 15 is a front view showing a substantial part of a reverse opening slide fastener in accordance with the present embodiment 2.

A reverse opening slide fastener 101 in the present embodiment 2 basically has the same structure except a matter that shapes of a slider engaging and disengaging portion 112 and a rib portion 117 of a second separable connection member 110 are different from the reverse opening slider fastener 1 in accordance with the embodiment 1 mentioned above.

Accordingly, in the reverse opening slide fastener 101 in accordance with the present embodiment 2, elements having the same structures as the members and the positions described in the embodiment 1 mentioned above are expressed by using the same reference numerals, whereby a description of them will not be repeated. In this case, with regard to reverse opening slide fasteners in accordance with embodiments 3 to 5 mentioned later, elements having the same structures as the embodiment 1 mentioned above are expressed by using the same reference numerals, whereby a description of them will not be repeated.

A second separable connection member 110 which is arranged in the second fastener stringer 20 in the left side in accordance with the present embodiment 2 has a main body portion 41 which is firmly fixed to the fastener tape 22, a slider engaging and disengaging portion 112 which is arranged in a rear end portion of the main body portion 41, a locking convex portion 43 which protrudes out of an opposite side surface opposed to the first separable connection member 30 of the main body portion 41, an elevated portion 44 which is arranged in an upper surface and a lower surface of the main body portion 41, a guide portion 45 which is arranged in a front end portion of the main body portion 41, an insertion concave portion 46 which is formed in a lower surface side of the main body portion 41 and can insert an auxiliary locking portion 35 of the first separable connection member 30, and a rib portion 117 which reinforces the second separable connection member 110 and facilitates an operation of the second separable connection member 110.

The slider engaging and disengaging portion 112 in the second separable connection member 110 is provided so as to protrude like a pin in an up and down direction from an upper surface and a lower surface in a rear end portion of the main body portion 41, and is formed in such a manner that it can lock with the shoulder port side end portions of the upper and lower flanges 55 and 56 of the first slider 50. Further, since the slider engaging and disengaging portion 112 is formed like the pin, the second separable connection member 110 is structured such that it can rotate in an inserting and removing direction (a clockwise direction and a counter-clockwise direction) with respect to the first slider 50 around a portion at which the slider engaging and disengaging portion 112 comes into contact with the first slider 50, in a state in which it is engaged with the first slider 50 by the slider engaging and disengaging portion 112.

The rib portion 117 in the second separable connection member 110 is arranged along a side edge in a tape inner side in the main body portion 41, and a rear end edge in the main body portion 41. Further, the rib portion 117 is connected to the pin-like slider engaging and disengaging portion 112.

In accordance with the reverse opening slide fastener 101 of the present embodiment 2 having the second separable connection member 110 mentioned above, it is possible to insert the second separable connection member 110 into the first and second sliders 50 and 60 from the gaps 71 and 72 between the upper and lower flanges 55, 56, 65 and 66 of the first and second sliders 50 and 60 by rotating the second separable connection member 110 after locking the second separable connection member 110 with the first slider 50 so as to position in the same manner as the embodiment 1 mentioned above, in the case of closing the separated left and right first and second fattener stringers 10 and 20.

In other words, the second separable connection member 110 is moved close from the left diagonally rear side of the first slider 50, after moving the first and second sliders 50 and 60 to the position of the sliding end portion. Further, a part of the main body portion 41 of the second separable connection member 110 is inserted into the element guide path 59 from the gap 71 between the upper and lower flanges 55 and 56 of the first slider 50, and the pin-like slider engaging and disengaging portion 112 of the second separable connection member 110 is locked with (caught on) the shoulder port side end edge portion of the upper and lower blades 52 and 53 of the first slider 50. In accordance with this, it is possible to position the second separable connection member 110 at a predetermined position with respect to the first slider 50 and the first separable connection member 30.

Further, the second separable connection member 110 locked with the first slider 50 is rotated in the inserting direction around the slider engaging and disengaging portion 112. In accordance with this, it is possible to easily and stably insert the inserting and removing region of the second separable connection member 110 into the element guide paths 59 and 69 via the gaps 71 and 72 between the upper and lower flanges 55, 56, 65 and 66 of the first and second sliders 50 and 60.

Accordingly, in the reverse opening slide fastener 101 in accordance with the present embodiment 2, in the same manner as the embodiment 1 mentioned above, it is possible to improve an operability of the connection and separation operation of the reverse opening slide fastener 101, and it is possible to reduce a possibility that the insertion of the second separable connection member 110 becomes insufficient.

Embodiment 3

Figure 16:
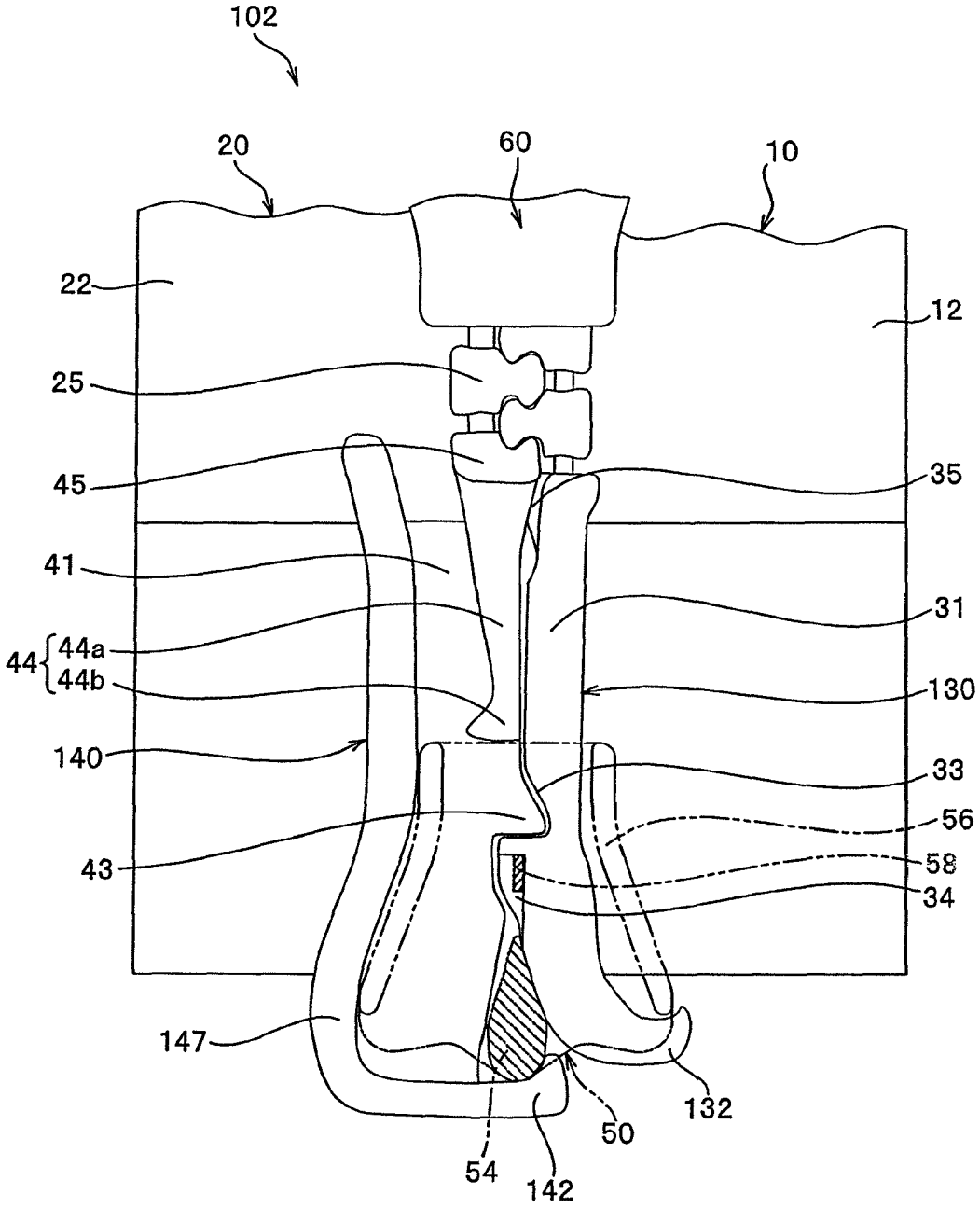
FIG. 16 is a front view showing a substantial part of a reverse opening slide fastener in accordance with embodiment 3 of the invention.

FIG. 16 is a front view showing a substantial part of a reverse opening slide fastener in accordance with the present embodiment 3.

A reverse opening slide fastener 102 in accordance with the present embodiment 3 basically has the same structure as the reverse opening slide fastener 1 in accordance with the embodiment 1 mentioned above, except a matter that a shape of a slider stop portion 132 of a first separable connection member 130 and shapes of a slider engaging and disengaging portion 142 and a rib portion 147 of a second separable connection member 140 are different.

The first separable connection member 130 in the present embodiment 3 has a main body portion 31 which is firmly fixed to the fastener tape 12, a slider stop portion 132 which is arranged in a rear end portion of the main body portion 31, a locking concave portion 33 which is arranged in an upper surface side of the main body portion 31 and can fit a locking convex portion of the second separable connection member 140, an accommodating concave portion 34 which is formed in an upper surface side of the main body portion 31 and can accommodated a part of the locking pawl 58 of the first slider 50, and an auxiliary locking portion 35 which protrudes out of an opposite side surface opposing to the second separable connection member 140 of the main body portion 31.

The slider stop portion 132 in the first separable connection member 130 is formed so as to be curved toward a tape inner side (a right side) of the fastener tape 12 in the right side from the rear end portion of the main body portion 31 in such a manner that it can come into contact with the shoulder port side end portion of the upper and lower flanges 55 and 56 in the first slider 50. In the first separable connection member 130, the slider stop portion 132 is formed in such a manner as to have the same thickness as the main body portion 31.

The second separable connection member 140 in accordance with the present embodiment 3 has a main body portion 41 which is firmly fixed to the fastener tape 22, a slider engaging and disengaging portion 142 which is arranged in a rear end portion of the main body portion 41, a locking convex portion 43 which protrudes out of an opposite side surface opposing to the first separable connection member 130 of the main body portion 41, an elevated portion 44 which is arranged in an upper surface and a lower surface of the main body portion 41, a guide portion 45 which is arranged in a front end portion of the main body portion 41, an insertion concave portion 46 which is formed in a lower surface side of the main body portion 41 and can insert an auxiliary locking portion 35 of the first separable connection member 130, and a rib portion 147 which reinforces the second separable connection member 140 and facilitates an operation of the second separable connection member 140.

The slider engaging and disengaging portion 142 in the second separable connection member 140 is formed in such a manner as to protrude toward a tape outer side (a right side) in a tape width direction, from an opposite side edge in the rear end portion of the main body portion 41. The slider engaging and disengaging portion 142 is formed so as to be thicker (larger in a thickness in an up and down direction) than the main body portion 41, and has the same thickness in the up and down direction as the rib portion 147.

The rib portion 147 in the second separable connection member 140 is arranged along a side edge in a tape inner side in the main body portion 41 and a rear end edge in the main body portion 41. Further, the rib portion 147 is connected to the slider engaging and disengaging portion 142 which protrudes to the side of the first separable connection member 130.

In accordance with the reverse opening slide fastener 102 of the present embodiment 3 having the first and second separable connection members 130 and 140 mentioned above, it is possible to insert the second separable connection member 140 into the first and second sliders 50 and 60 from the gaps 71 and 72 between the upper and lower flanges 55, 56, 65 and 66 of the first and second sliders 50 and 60, by rotating the second separable connection member 140 after locking the second separable connection member 140 with the first slider 50 so as to position, in the same manner as the embodiment 1 mentioned above, in the case of closing the separated left and right first and second fastener stringers 10 and 20. In accordance with this, it is possible to improve an operability of the connection and separation operation of the reverse opening slide fastener 102, and it is possible to reduce the possibility that the insertion of the second separable connection member 140 becomes insufficient.

Embodiment 4

Figure 17:
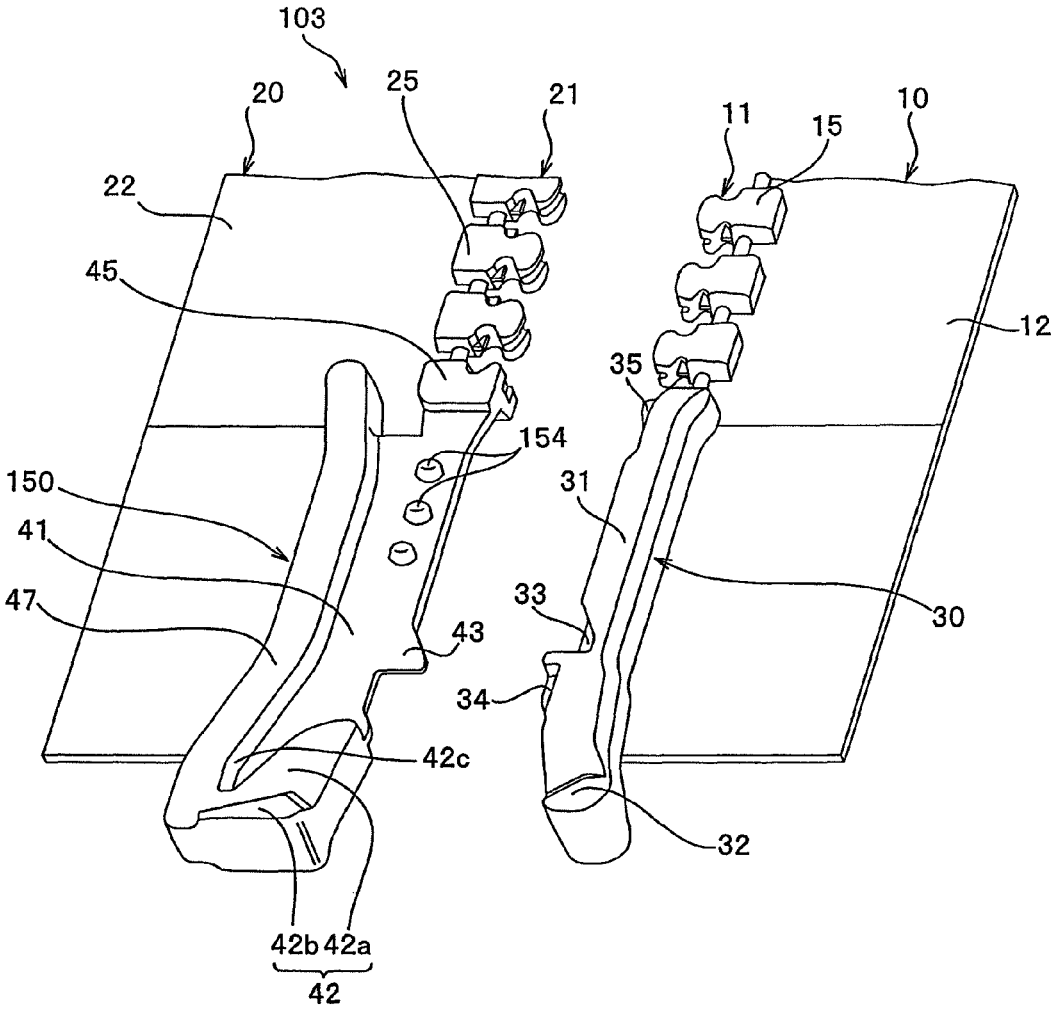
FIG. 17 is a perspective view showing a substantial part of a reverse opening slide fastener in accordance with embodiment 4 of the invention.
Figure 18:
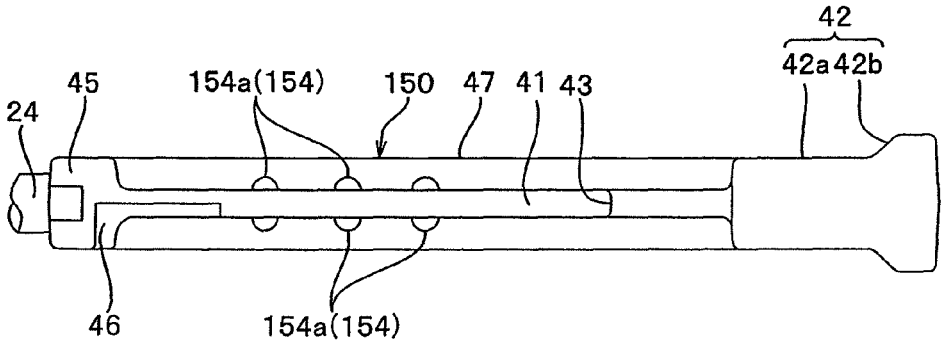
FIG. 18 is a side view showing a second separable connection member of the reverse opening slide fastener.
Figure 19:
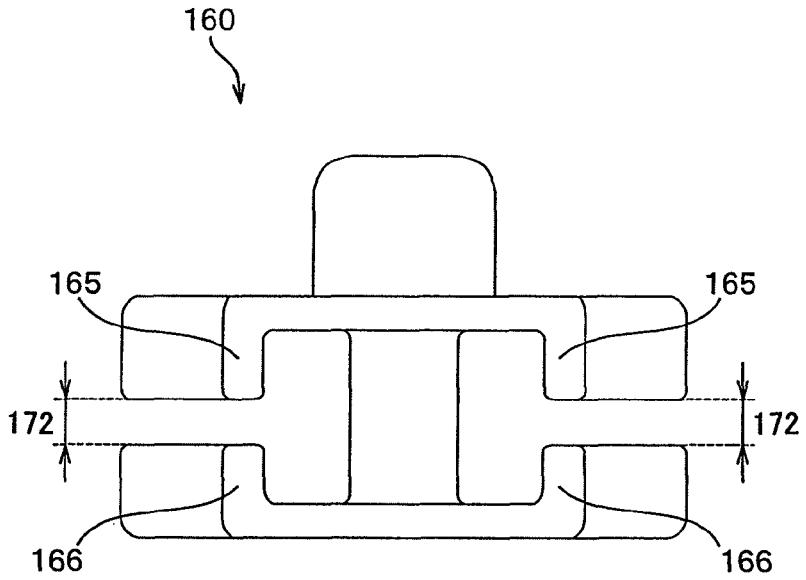
FIG. 19 is a schematic view showing a second slider used in the reverse opening slide fastener at a time of viewing from a rear port side.

FIG. 17 is a perspective view showing a substantial part of a reverse opening slide fastener in accordance with the present embodiment 4, and FIG. 18 is a side view showing a second separable connection member of the reverse opening slide fastener. Further, FIG. 19 is a schematic view at a time of viewing a second slider used in the reverse opening slide fastener from a rear port side.

A reverse opening slide fastener 103 in accordance with the present embodiment 4 basically has the same structure as the reverse opening slide fastener 1 in accordance with the embodiment 1 mentioned above, except a matter that a shape of an elevated portion 154 of a second separable connection member 150 and a distance 172 between upper and lower flanges 165 and 166 in a second slider 160 are different.

The second separable connection member 150 in the present embodiment 4 has a main body portion 41 which is firmly fixed to the fastener tape 22, a slider engaging and disengaging portion 42 which is arranged in a rear end portion of the main body portion 41, a locking convex portion 43 which protrudes out of an opposite side surface opposing to the first separable connection member 30 of the main body portion 41, an elevated portion 154 which is arranged in an upper surface and a lower surface of the main body portion 41, a guide portion 45 which is arranged in a front end portion of the main body portion 41, an insertion concave portion 46 which is formed in a lower surface side of the main body portion 41 and can insert an auxiliary locking portion 35 of the first separable connection member 30, and a rib portion 47 which reinforces the second separable connection member 150 and facilitates an operation of the second separable connection member 150.

The elevated portion 154 in the second separable connection member 150 has a plurality of removal preventing elevated portions **154*a* which are elevated like a semispherical shape from the upper surface and the lower surface of the main body portion 41. In this case, three removal preventing elevated portions 154*a* are arranged along a back and forth direction at a predetermined distance, in each of the upper and lower surfaces of the main body portion 41. Note that, in the second separable connection member 150 in accordance with the present embodiment 4, a corresponding element to the position retaining elevated portion 54*b*** in the embodiment 1 mentioned above is not provided.

In the present embodiment 4, a second slider 160 which is arranged in a forward side (the stop device 13 side) has the same shape as the first slider 50 which is arranged in a rear side (the first separable member 30 side). In other words, a distance 71 between the upper and lower flanges 55 and 56 of the first slider 50 and a distance 172 between upper and lower flanges 165 and 166 of the second slider 160 are set to the same magnitude as each other.

Figure 20:
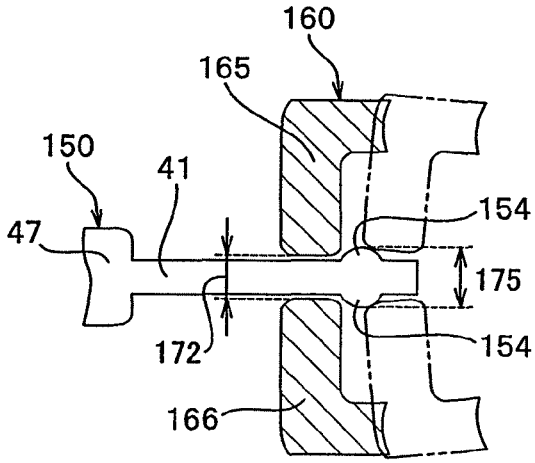
FIG. 20 is an explanatory view explaining a relationship between a removal preventing elevated portion of the second separable connection member and a distance between upper and lower flanges in the second slider, in the reverse opening slide fastener.

Further, the distances 71 and 172 between the upper and lower flanges 55, 56, 165 and 166 of the first and second sliders 50 and 160 are set to be larger than a thickness of the main body portion 41 in the second separable connection member 150, and be smaller than a thickness 175 of the elevated portion 154 in the second separable connection member 150, as shown in FIG. 20.

In the reverse opening slide fastener 103 in accordance with the present embodiment 4 having the second separable connection member 150 and the second slider 160 mentioned above, in the case of closing the separated left and right first and second fastener stringers 10 and 20, first of all, the slider engaging and disengaging portion 42 of the second separable connection member 150 is locked with the first slider 50 so as to position the second separable connection member 150. Subsequently, the second separable connection member 150 is rotated in a clockwise direction (an inserting direction) around the portion which comes into contact with the first slider 50.

At this time, a removal preventing elevated portion **154*a* of the second separable connection member 150 is set to be larger than the interval 172 between the upper and lower flanges 165 and 166 of the second slider 160, however, the second separable connection member 150 is pressed into the gap between the upper and lower flanges 55, 56, 165 and 166 of the first and second sliders 50 and 160**.

In accordance with this, it is possible to insert the removal preventing elevated portion **154*a* into the element guide path 69 of the second slider 160 so as to accommodate while deflecting the upper and lower flanges 165 and 166 of the second slider 160 as shown in FIG. 20 so as to expand the distance 172 between the upper and lower flanges 165 and 166. Thereafter, it is possible to smoothly close the first and second fastener stringers 10 and 20 by sliding the second slider 160** toward the forward side.

On the other hand, in the case of separating the first and second fastener stringers 10 and 20 in a state in which the element rows 11 and 21 are engaged, and opening the reverse opening slide fastener 103, the second separable connection member 150 is rotated after moving the first and second sliders 50 and 160 to a position of the sliding end portion.

In accordance with this, the removal preventing elevated portion 154*a* of the second separable connection member 150 is removed from the element guide paths 59 and 69 of the first and second sliders 50 and 160 via the distances 71 and 172 between the upper and lower flanges 55, 56, 165 and 166. At this time, the elevated portion 154 of the second separable connection member 150 can be easily removed by deflecting the upper and lower flanges 165 and 166 of the second slider 160 so as to expand the distance 172 between the upper and lower flanges 165 and 166.

After the removal preventing elevated portion 154*a* of the second separable connection member 150 is removed from the second slider 160 as mentioned above, the second separable connection member 150 is moved leftward diagonally rearward with respect to the first slider 50. In accordance with this, it is possible to separate the first fastener stringer 10 and the second fastener stringer 20.

In this case, the description is given above of the matter that distance 71 between the upper and lower flanges 55 and 56 of the first slider 50 and the distance 172 between the upper and lower flanges 165 and 166 of the second slider 160 are set to the same magnitude, as described in FIG. 19, however, the invention is not limited to this, but can be structured, for example, such that the distance 172 is set to be larger than the distance 71, the distance 172 is set to such a dimension that can go over the removal preventing elevated portion 154*a*, and the distance 71 is set to such a dimension that can not go over the removal preventing elevated portion 154*a*.

Even in the reverse opening slide fastener 103 in accordance with the present embodiment 4 as mentioned above, it is possible to insert and remove the second separable connection member 150 into and from the first and second sliders 50 and 160 via the gaps 71 and 172 between the upper and lower flanges 55, 56, 165 and 166 of the first and second sliders 50 and 160. In accordance with this, it is possible to improve an operability of the connection and separation operation of the reverse opening slide fastener 103, and it is possible to reduce the possibility that the insertion of the second separable connection member 150 becomes insufficient.

Embodiment 5

Figure 21:
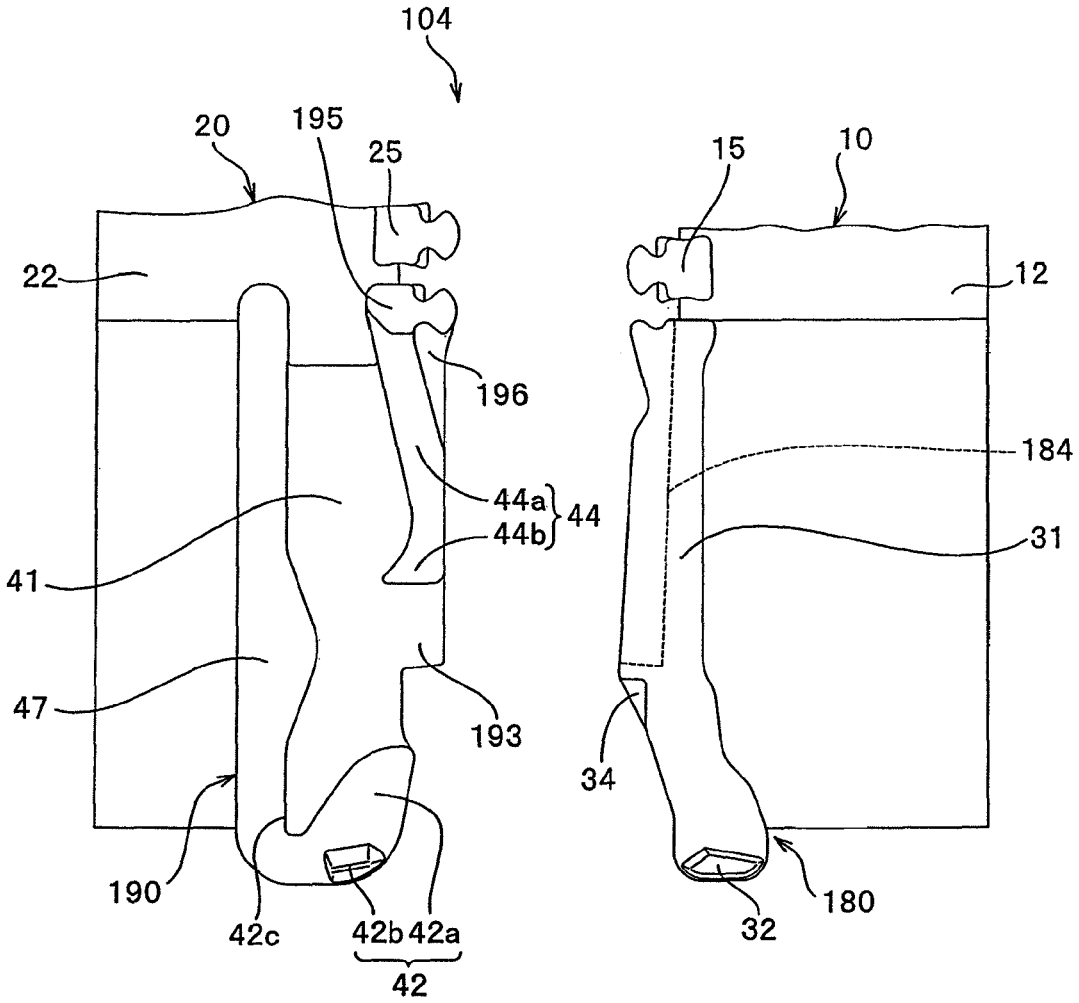
FIG. 21 is a front view showing a substantial part of a reverse opening slide fastener in accordance with embodiment 5 of the invention.
Figure 22:
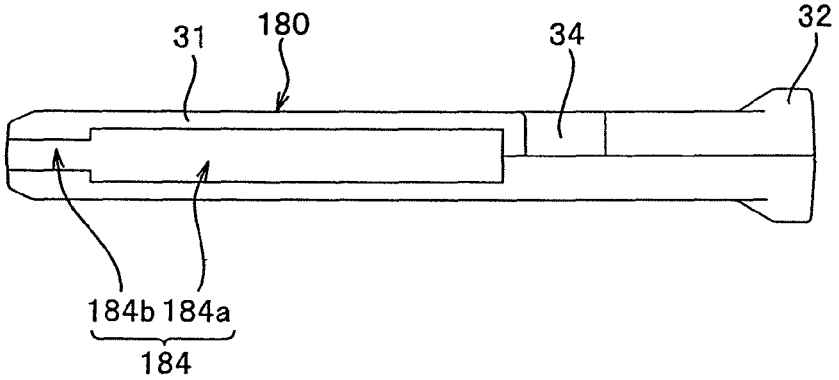
FIG. 22 is a side view of a first separable connection member in the reverse opening slide fastener.

FIG. 21 is a front view showing a substantial part of a reverse opening slide fastener in accordance with the present embodiment 5, and FIG. 22 is a side view of a first separable connection member in the reverse opening slide fastener.

In a reverse opening slide fastener 104 in accordance with the present embodiment 5, a structure for preventing a relative position between a first separable connection member 180 and a second separable connection member 190 from being shifted in an up and down direction, at a time of engaging the left and right element rows 11 and 21 is different from the embodiments 1 to 4 mentioned above.

Specifically, the first separable connection member 180 in accordance with the present embodiment 5 has a main body portion 31 which is firmly fixed to the fastener tape 12, a slider stop portion 32 which is arranged in a rear end portion of the main body portion 31, a locking groove portion 184 which is provided in a concave manner on an opposite side surface side of the main body portion 31, and an accommodating concave portion 34 which is formed in an upper surface side of the main body portion 31, and can accommodate a part of the locking pawl 58 of the first slider 50.

The locking groove portion 184 which is formed in the first separable connection member 180 is formed in such a manner that it can fit an elevated portion 44, a fitting piece portion 193 and a thin portion 196 which are mentioned later of the second separable connection member 190. The locking groove portion 184 has a first locking groove portion 184*a* which is formed at a groove width (a distance in an up and down direction of the groove) which can fit the elevated portion 44 of the second separable connection member 190, and a second locking groove portion 184*b* which is smaller in a groove width than the first locking groove portion 184*a* and fits the thin portion 196 mentioned below of the second separable connection member 190, as shown in FIG. 22.

In this case, an upper wall portion and a lower wall portion which construct the second locking groove portion 184*b* have a shape corresponding to a shape of the thin portion 196 formed in the second separable connection member 190, at a time of viewing from an upper surface or a lower surface. Further, front ends of the upper wall portion and the lower wall portion which construct the second locking groove portion 184 are formed as an irregular shape such as an element shape, in such a manner as to be engaged to a guide portion 195 of the second separable connection member 190.

The second separable connection member 190 in the present embodiment 5 has a main body portion 41 which is firmly fixed to the fastener tape 22, first and second slider engaging and disengaging portions 42*a* and 42*b* which are arranged in a rear end portion of the main body portion 41, an elevated portion 44 which is arranged in an upper surface and a lower surface of the main body portion 41, a fitting piece portion 193 which is extended to a rear side of the elevated portion 44 and is fitted into the locking groove portion 184 of the first separable connection member 180, a thin portion 196 which is provided in a front end side of the elevated portion 44, a guide portion 195 which is arranged in a front end edge of the main body portion 41, and a rib portion 47 which reinforces the second separable connection member 190.

The fitting piece portion 193 in the second separable connection member 190 is formed into a rectangular shape from the elevated portion 44 toward a rear side. Further, in the present embodiment 5, an opposite side surface which opposes to the first separable connection member 180 of the fitting piece portion 193, the opposite side surface of the elevated portion 44, and the opposite side surface of the thin portion 196 are arranged on the same plane. It is possible to enhance a strength of the fitting piece portion 193 so as to make it hard for the fitting piece portion 193 to be broken, by arranging the opposite side surface of the fitting piece portion 193 on the same plane as the opposite side surfaces of the elevated portion 44 and the thin portion 196.

The fitting piece portion 193 is formed in such a manner as to have the same thickness as the thickness of the main body portion 41 of the second separable connection member 190. In this case, a rear side of the fitting piece portion 193 is notched to a tape inner side (a left side) in such a manner as to prevent the second separable connection member 190 from interfering with a rear side wall surface portion of the locking groove portion 184 and a forward side wall surface portion of the accommodating concave portion 34 in the first separable connection member 180.

The thin portion 196 in the second separable connection member 190 is provided so as to be directed to the tape inner side from the opposite side surface of the second separable connection member 190, and is arranged in such a manner as to be surrounded by the elevated portion 44 and the guide portion 195. The thin portion 196 is formed in such a manner as to have the same thickness as the thickness of the main body portion 41 of the second separable connection member 190 in the same manner as the fitting piece portion 193.

The guide portion 195 in the second separable connection member 190 is formed thicker than the elevated portion 44, and a thickness in an up and down direction in the guide portion 195 is set to be the same as the thickness of the fastener element 25. Further, a front half portion of the guide portion 195 is formed so as to have an element shape in such a manner that it can be engaged to the fastener element 15, and a rear half portion is formed into such an irregular shape that can be engaged to the front end portions of the upper wall portion and the lower wall portion which construct the locking groove portion 184 of the first separable connection member 180.

In accordance with the reverse opening slide fastener 104 in accordance with the present embodiment 5 which has the first and second separable connection members 180 and 190 as mentioned above, it is possible to insert the second separable connection member 190 into the first and second sliders 50 and 60 from the gaps 71 and 72 between the upper and lower flanges 55, 56, 65 and 66 of the first and second sliders 50 and 60, by rotating the second separable connection member 190 after locking the second separable connection member 190 with the first slider 50 so as to position, in the same manner as the embodiment 1 mentioned above. Accordingly, it is possible to improve an operability of the connection and separation operation of the reverse opening slide fastener 104, and it is possible to reduce the possibility that the insertion of the second separable connection member 190 becomes insufficient.

Figure 23:
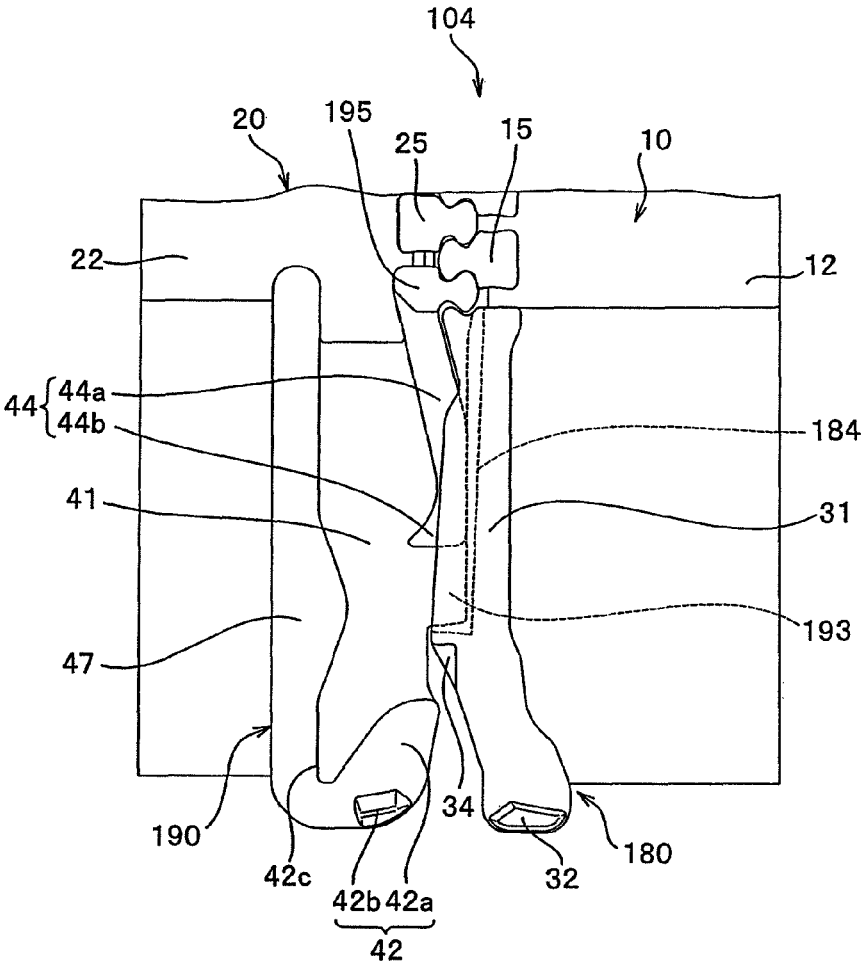
FIG. 23 is a front view showing a state in which right and left element rows are engaged, in the reverse opening slide fastener.

Further, in the reverse opening slide fastener 104 in accordance with the present embodiment 5, it is possible to fit the elevated portion 44, the fitting piece portion 193 and the thin portion 196 of the second separable connection member 190 into the locking groove portion 184 of the first separable connection member 180, as show in FIG. 23, at a time of engaging the left and right element rows 11 and 21.

In accordance with this, there comes such a state that the upper wall portion and the lower wall portion which construct the locking groove portion 184 of the first separable connection member 180, and the fitting piece portion 193, the elevated portion 44 and the thin portion 196 of the second separable connection member 190 overlap each other. Accordingly, in the reverse opening slide fastener 104, for example, even if the first and second separable connection members 180 and 190 are exposed to the stress in the up and down direction in the state in which the left and right element rows 11 and 21 are engaged, it is possible to more securely prevent the relative position of the first separable connection member 180 and the second separable connection member 190 from being shifted in the up and down direction.

Note that, in the embodiments 1 to 5 in accordance with the invention, the description is given on the assumption that the distance between the upper blades 52 and 82 and the lower blades 53 and 83 in the side edges of the first sliders 50, 80 and 90, and the distance between the upper blades 62 and 82 and the lower blades 63 and 83 in the side edges of the second sliders 60, 80, 90 and 160 are the distances between the upper and lower flanges 55, 56, 65, 66, 85, 86, 95, 96, 165 and 166.

Figure 24:
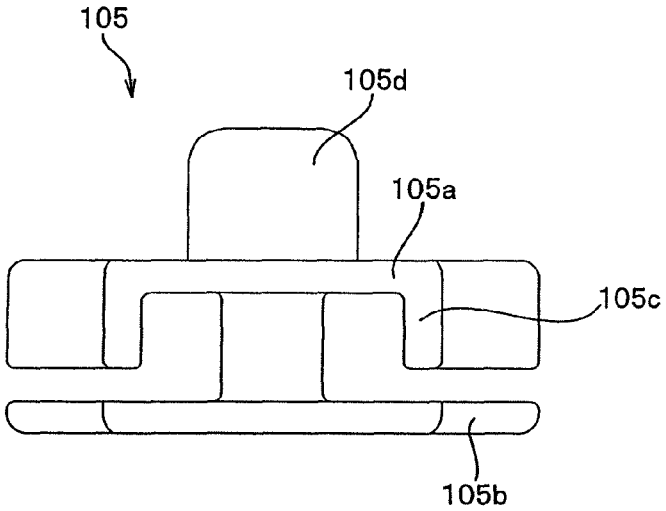
FIG. 24 is a schematic view at a time of viewing first and second sliders in accordance with a modified example from a rear port side.
Figure 25:
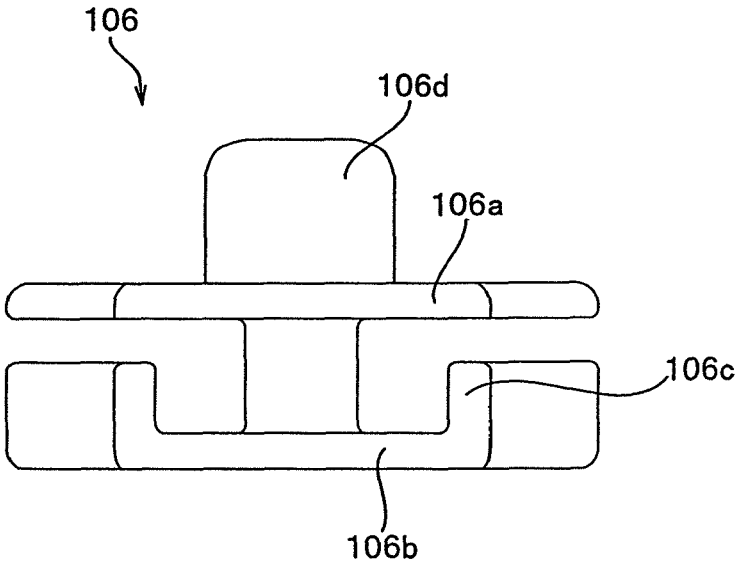
FIG. 25 is a schematic view at a time of viewing first and second sliders in accordance with the other modified example from a rear port side.
Figure 26:
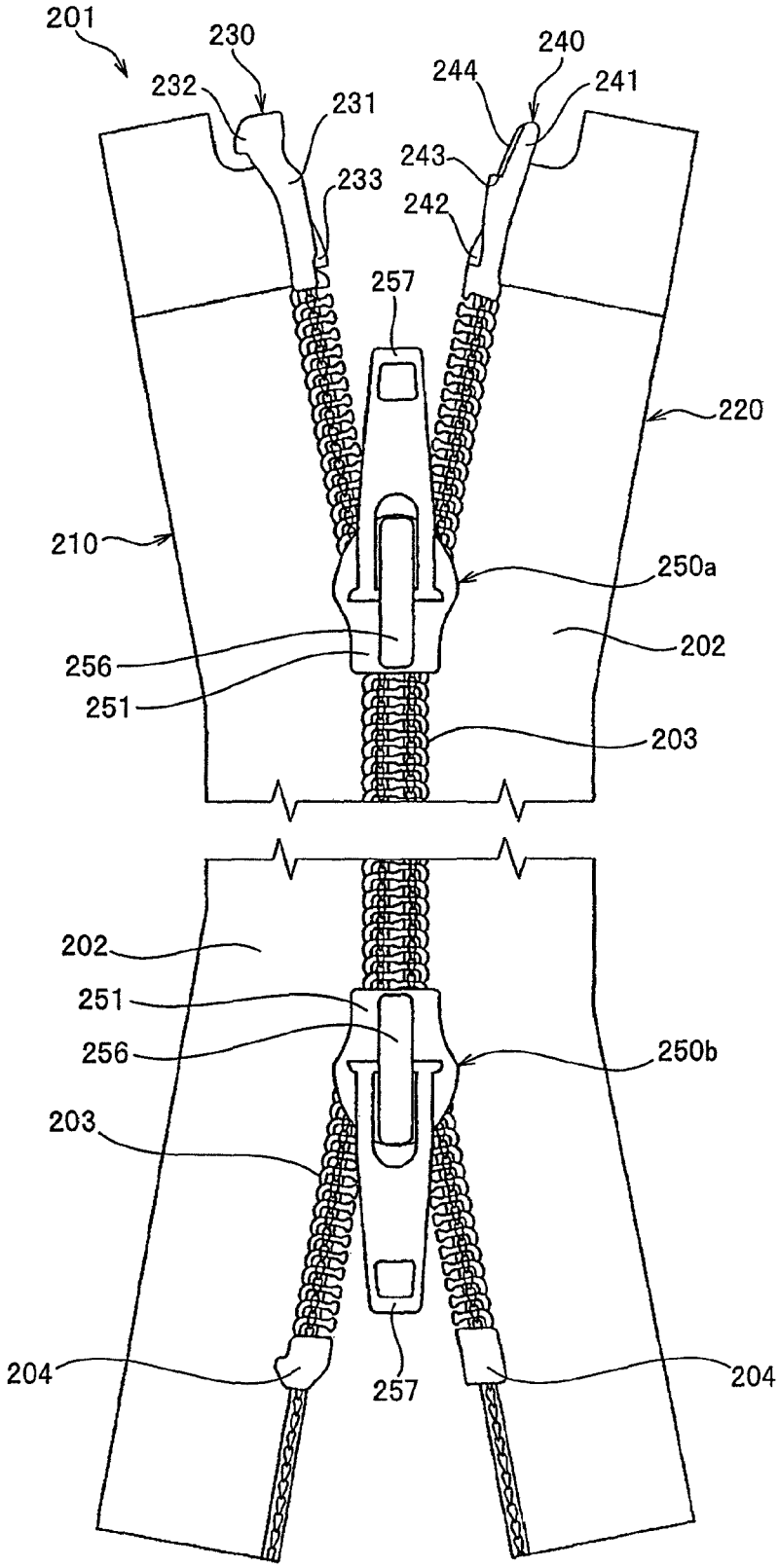
FIG. 26 is a front view showing a conventional reverse opening slide fastener.
Figure 27:
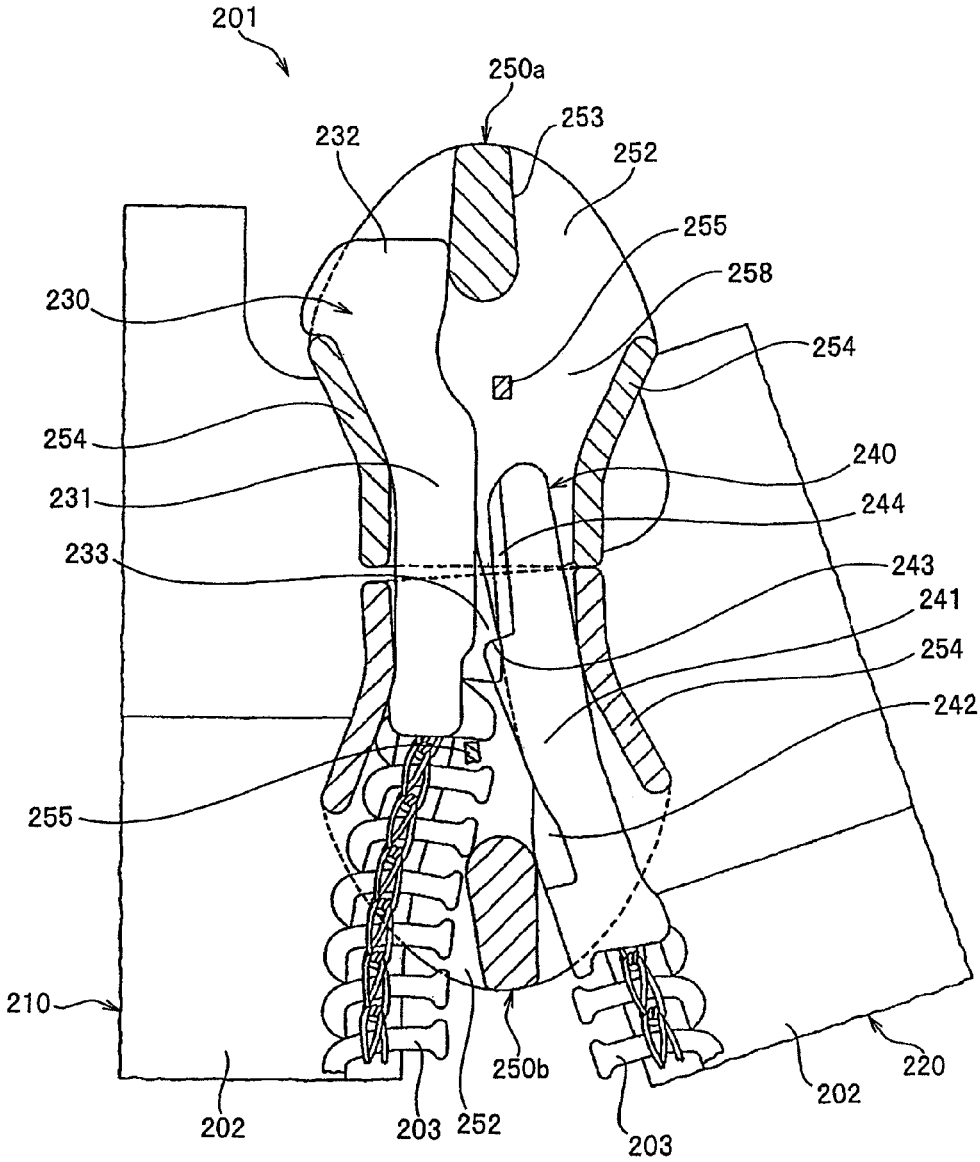
FIG. 27 is a schematic view explaining an operation for inserting a second separable connection member to first and second sliders in the reverse opening slide fastener.
Figure 28:
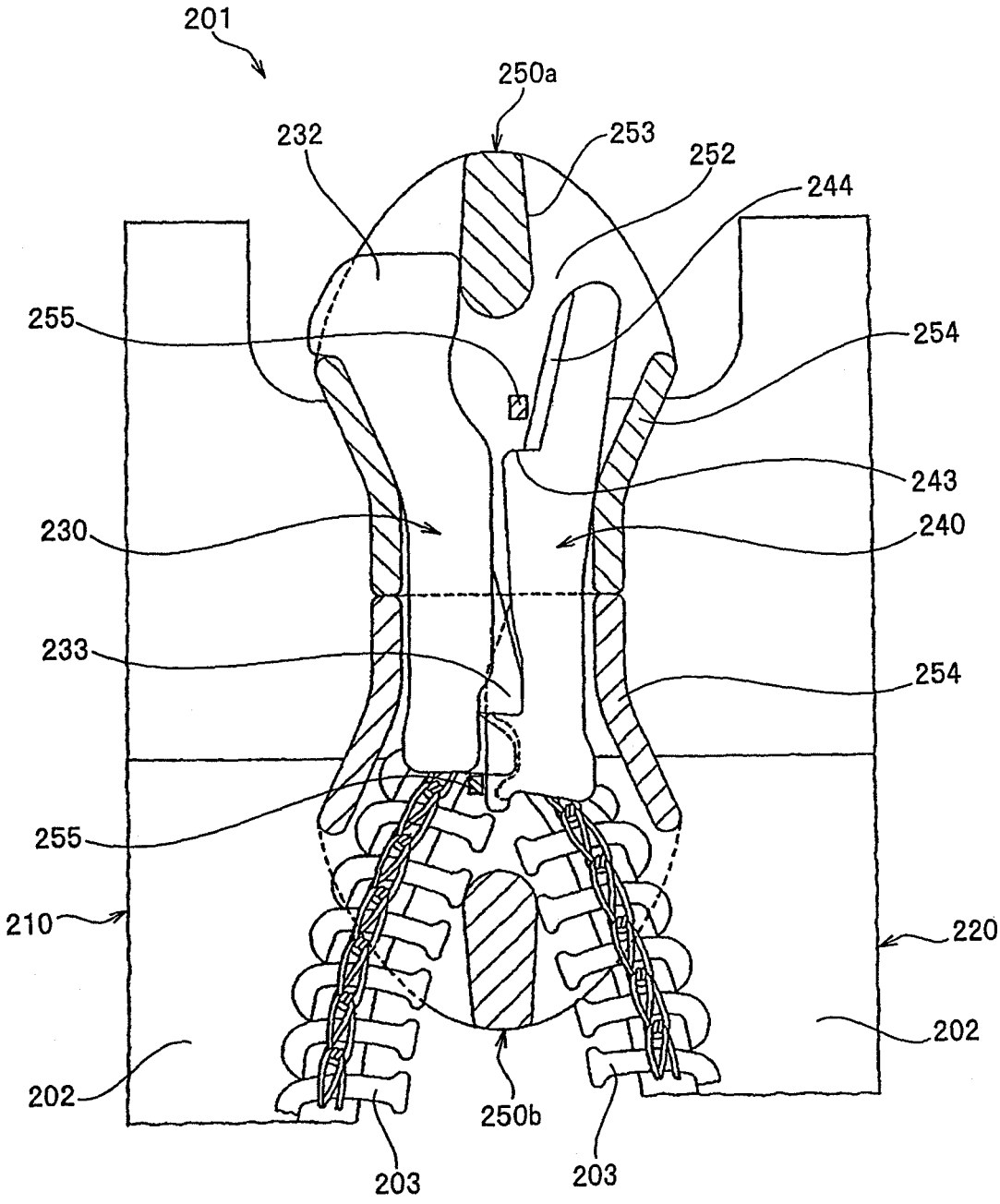
FIG. 28 is a schematic view showing a state in which the second separable connection member is inserted to the first and second sliders in the reverse opening slide fastener.
Figure 29:
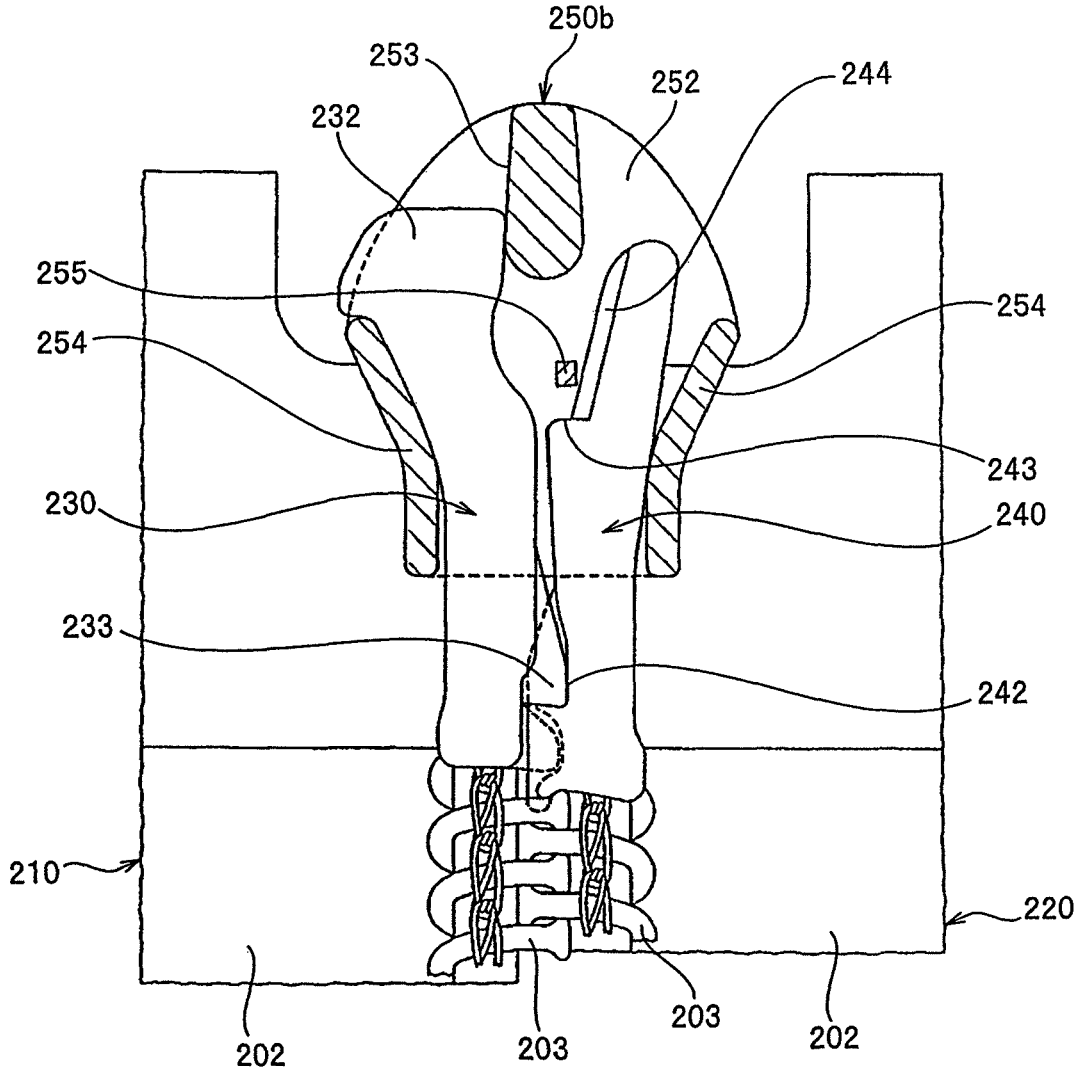
FIG. 29 is a schematic view showing a state in which the reverse opening slide fastener is closed.

However, in the reverse opening slide fastener in accordance with the invention, as the first slider and the second slider, for example, it is possible to employ a slider 105 in which the gap between the side edge portion of the upper blade and the side edge portion of the lower blade is constructed by a gap between an upper flange 105*c* which is arranged in an upper blade 105*a*, and a lower blade 105*b*, as shown in FIG. 24, and a slider 106 in which the gap between the side edge portion of the upper blade and the side edge portion of the lower blade is constructed by a gap between an upper blade 106*a*, and a lower flange 106*c* which is arranged in a lower blade 106*b*, as shown in FIG. 25.

In this case, the gaps between the upper flanges 55, 56, 65, 66, 85, 86, 95, 96, 165 and 166 described in the embodiments 1 to 5 mentioned above can be replaced by the gap between the upper flange 105*c* and the lower blade 105*b*, or the gap between the upper blade 106*a* and the lower flange 106*c*.

In this case, the sliders 105 and 106 shown in FIGS. 24 and 25 are frequently used, for example, in a coil slide fastener in which a coil element is firmly fixed to one surface of the fastener tape. The slider 105 shown in FIG. 24 is a slider in which a catch attaching post 105*d* is attached to the upper blade 105*a* arranged in the same direction as the surface on which the coil element of the fastener tape is firmly fixed (that is, a front use slider). On the other hand, the slider 106 shown in FIG. 25 is a slider in which a catch attaching post 106*d* is attached to the upper blade 106*a* which is arranged in an opposite direction to the surface to which the coil element of the fastener tape is firmly fixed (that is, a back use slider).

DESCRIPTION OF REFERENCE NUMERALS

1 reverse opening slide fastener
10 first fastener stringer
11 element row
12 fastener tape
13 stop device
14 core thread portion
15 fastener element
16 reinforcing portion
20 second fastener stringer
21 element row
22 fastener tape
23 stop device
24 core thread portion
25 fastener element
26 reinforcing portion
30 first separable connection member
31 main body portion
32 slider stop portion
33 locking concave portion
33*a* wall surface portion
34 accommodating concave portion
34*a* wall surface portion
35 auxiliary locking portion
40 second separable connection member
41 main body portion
42 slider engaging and disengaging portion
42*a* first engaging and disengaging portion
42*b* second engaging and disengaging portion
42*c* inserting groove
43 locking convex portion
44 elevated portion
44*a* removal preventing elevated portion
44*b* position retaining elevated portion
45 guide portion
46 inserting concave portion
47 rib portion
50 first slider
50 slider body
51*a* catch
52 upper blade
53 lower blade

54 connecting post
55 upper flange
56 lower flange
57 catch attaching post
58 locking pawl
59 element guide path
60 second slider
61 slider body
61*a* catch
62 upper blade
63 lower blade
64 connecting post
65 upper flange
66 lower flange
67 catch attaching post
68 locking pawl
69 element guide path
71 distance between upper and lower flanges of first slider
72 distance between upper and lower flanges of second slider
73 thickness of main body portion in second separable connection member
74 thickness of first engaging and disengaging portion in second separable connection member
75 thickness of elevated portion in second separable connection member
76 distance between upper and lower flanges in left side of slider
77 distance between upper and lower flanges in right side of slider
78 distance between upper and lower flanges in left side of slider
79 distance between upper and lower flanges in right side of slider
80 slider
81 slider body
82 upper blade
83 lower blade
84 connecting post
85 upper flange
86 lower flange
87 catch attaching post
89 element guide path
90 slider
91 slider body
95 upper flange
96 lower flange
101 reverse opening slide fastener
102 reverse opening slide fastener
103 reverse opening slide fastener
104 reverse opening slide fastener
105 slider
105*a* upper blade
105*b* lower blade
105*c* upper flange
105*d* catch attaching post
106 slider
106*a* upper blade
106*b* lower blade
106*c* lower flange
106*d* catch attaching post
110 second separable connection member
112 slider engaging and disengaging portion
117 rib portion
130 first separable connection member
132 slider stop portion
140 second separable connection member
142 slider engaging and disengaging portion
147 rib portion
150 second separable connection member
154 elevated portion
154*a* removal preventing elevated portion
160 second slider
165 upper flange
166 lower flange
172 distance between upper and lower flanges of second slider
175 thickness of elevated portion in second separable connection member
180 first separable connection member
184 locking groove portion
184*a* first locking groove portion
184*b* second locking groove portion
190 second separable connection member
193 fitting piece portion
195 guide portion
196 thin portion

The invention claimed is:

1. A reverse opening slide fastener including first and second sliders and being capable of carrying out a connection and separation operation by inserting and removing first and second separable connection members into and from the second slider, the reverse opening slide fastener including a pair of first and second fastener stringers in which element rows are attached to tape side edge portions of first and second fastener tapes, the first and second separable connection members which are firmly fixed to respective end portions of the element rows, and the first and second sliders which are attached so as to oppose each other at their rear port sides and to be slidable along the element rows of the first fastener stringer, and being capable of carrying out a separation and connection of the first and second fastener stringers by the connection and separation operation by inserting and removing the second separable connection member into and from the first and second sliders, wherein the second separable connection member has an inserting and removing region which is capable of being inserted and removed into and from the first and second sliders via gaps formed between a side edge portion of an upper blade and a side edge portion of a lower blade which are arranged respectively in the first and second sliders, and the first and second separable connection members include a positioning structure which determines a relative position between the first and the second separable connection members, at a time of an inserting and removing operation of the second separable connection member into and from the first separable connection member, and the second separable connection member has a main body portion which is firmly fixed to the second fastener tape, and a slider engaging and disengaging portion which is arranged in a leading end portion in a tape length direction in the main body portion, and is capable of engaging with and disengaging from the first slider, and the positioning structure includes a retaining structure which retains the first slider to a sliding end portion, and the slider engaging and disengaging portion, and a removal preventing elevated portion is arranged in the inserting and removing region of the second slider side, and a distance between the upper and lower flanges on the second separable connection member side in the first slider is set to be smaller than a thickness of the removal preventing elevated portion, and a distance between the upper and lower flanges on the second separable connection member side in the second slider is set to be larger than the thickness of the removal preventing elevated portion.

2. The reverse opening slide fastener according to claim 1, wherein the slider engaging and disengaging portion is formed in such a manner as to be capable of rotating the second separable connection member in an inserting and removing direction with respect to the first and second slider, in a state of being locked with the first slider.

3. The reverse opening slide fastener according to claim 1, wherein the first and second sliders have upper and lower blades, a diamond which connects the upper and lower blades, an upper flange which is provided so as to be hanged from right and left side edges of the upper blade, and a lower flange which is provided so as to rise from right and left side edges of the lower blade, and that a shoulder side end portion in the first slider includes a shoulder port side end edge portion of the upper blade, a shoulder port side end edge portion of the lower blade, the diamond, a shoulder port side end portion of the upper flange, and a shoulder port side end portion of the lower flange.

4. The reverse opening slide fastener according to claim 1, wherein the second separable connection member has a guide portion in a base end portion of the element row side in the main body portion, and that the guide portion is arranged in such a manner as to be capable of going into an element guide path from a shoulder port of the second slider at a time of inserting the second separable connection member into the first and second sliders in the case that the second slider is at a predetermined position.

5. The reverse opening slide fastener according to claim 1, wherein the second separable connection member has a locking convex portion which is provided so as to protrude in a tape width direction from an opposite side edge opposing to the first separable connection member of the main body portion, or a locking concave portion which is provided so as to concave toward a tape inner side from the opposite side edge, and that the first separable connection member has a locking concave portion which fits the locking convex portion arranged in the second separable connection member, or a locking convex portion which fits into the locking concave portion arranged in the second separable connection member.

6. The reverse opening slide fastener according to claim 1, wherein the second separable connection member has a position retaining elevated portion which comes into contact with a rear port side end portion of at least one of the upper and lower flanges of the first slider so as to retain the second separable connection member at a predetermined position, in at least one of a first surface and a second surface of the main body portion.

7. The reverse opening slide fastener according to claim 1, wherein a distance between the upper and lower flanges which are arranged on a first separable connection member side in the first slider is set to be the same as a distance between the upper and lower flanges which are arranged on the second separable connection member side of the second slider, and that a distance between the upper and lower flanges which are arranged on the first separable connection member side in the second slider is set to be the same as a distance between the upper and lower flanges which are arranged on the second separable connection member side of the first slider.

8. The reverse opening slide fastener according to claim 1, wherein the retaining structure is constructed by a locking pawl which is arranged in the first slider, and is capable of retaining a stop position of the first slider with respect to the element rows, and an accommodating concave portion which is formed in the first separable connection member and is capable of receiving the locking pawl.

9. A reverse opening slide fastener including first and second sliders and being capable of carrying out a connection and separation operation by inserting and removing first and second separable connection members into and from the second slider, the reverse opening slide fastener including first and second element rows which are attached along an opposing tape side edge portion of first and second fastener tapes and the first and second sliders which are attached so as to oppose each other at their rear port sides and are slidable along the element rows, and wherein the second separable connection member has an inserting and removing region which is capable of being inserted and removed into and from the first and second sliders via gaps formed between side edge portions of an upper blade and a lower blade which are arranged respectively in the first and second sliders, and the first and the second separable connection members including a positioning structure which determines a relative position between the first and the second separable connection members, at a time of an inserting and removing operation of the second separable connection member into and from the first separable connection member and being capable of carrying out a separation and connection of the first and second fastener stringers by the connection and separation operation by inserting and removing the second separable connection member into and from the first and second sliders, and the second separable connection member has a main body portion which is firmly fixed to the second fastener tape, and a slider engaging and disengaging portion which is arranged in a leading end portion in a tape length direction in the main body portion and is capable of engaging with and disengaging from the first slider, and the positioning structure includes a retaining structure which retains the first slider to a sliding end portion, and the slider engaging and disengaging portion, and the slider engaging and disengaging portion is composed of a first engaging and disengaging portion which is thinner than a gap between the upper blade and the lower blade which forms an element guide path of the first slider and a second engaging and disengaging portion which is thicker than a gap between the upper blade and the lower blade.

* * * * *

UNITED STATES PATENT AND TRADEMARK OFFICE

CERTIFICATE OF CORRECTION

PATENT NO. : 8,844,101 B2
APPLICATION NO. : 13/518888
DATED : September 30, 2014
INVENTOR(S) : Jiro Nozaki et al.

It is certified that error appears in the above-identified patent and that said Letters Patent is hereby corrected as shown below:

In the Specification

In column 4, line 39, delete “slidablly” and insert -- slidably --, therefor.

In column 32, line 64, delete “50” and insert -- 51 --, therefor.

Signed and Sealed this
Third Day of February, 2015

Michelle K. Lee

Michelle K. Lee
*Deputy Director of the United States Patent and Trademark Office*